US006360830B1

(12) United States Patent
Price

(10) Patent No.: US 6,360,830 B1
(45) Date of Patent: Mar. 26, 2002

(54) BLOCKING SYSTEM FOR A DIRECTIONAL DRILLING MACHINE

(75) Inventor: Trail Price, Monroe, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 09/602,036

(22) Filed: Jun. 23, 2000

(51) Int. Cl.[7] ..... E21B 19/14

(52) U.S. Cl. ..... 175/52; 175/85; 166/85.1; 414/745.7

(58) Field of Search ..... 166/77.51, 77.52, 166/85.1, 85.5; 175/52, 85; 414/745.4, 745.7

(56) References Cited

U.S. PATENT DOCUMENTS

| | | | | |
|---|---|---|---|---|
| 4,445,579 A | * | 5/1984 | Bello | 175/52 |
| 4,604,724 A | * | 8/1986 | Shaginian et al. | 364/478 |
| 4,632,618 A | | 12/1986 | Issakainen | |
| 4,897,009 A | * | 1/1990 | Powell | 175/52 |
| 5,174,389 A | * | 12/1992 | Hansen | 175/52 |
| 5,556,253 A | | 9/1996 | Rozendaal et al. | |
| 5,607,280 A | | 3/1997 | Rozendaal | |
| 5,687,804 A | | 11/1997 | Lappalainen et al. | |
| 5,941,324 A | * | 8/1999 | Bennett | 175/85 |
| 6,085,852 A | | 7/2000 | Sparks et al. | |

FOREIGN PATENT DOCUMENTS

EP 0 984 132 A2 3/2000

OTHER PUBLICATIONS

Vermeer Manufacturing Company's 1995 D–50 Navigator Parts Manual.

Vermeer Manufacturing Company's 1996 D24/40 Navigator Parts Manual.

Exhibit A: pp. 35–11 to 35–13 of Vermeer Manufacturing Company's 1996 D24/40 Navigator Operator's Manual.

Exhibit B: Drawing showing exploded view of a rod selector used on Vermeer Manufacturing Company's D24/40A Navigator. The D24/40A Navigator shown was sold before Jun. 23, 1999.

* cited by examiner

*Primary Examiner*—Frank Tsay

(57) ABSTRACT

A horizontal directional drilling machine including a magazine for holding a plurality of rods. The magazine includes a plurality of columns in which the rods are held. Each of the columns has a separate bottom opening. A feed structure is positioned beneath the magazine. The feed structure includes a plurality of upwardly opening pockets sized for receiving the rods from the columns. The horizontal directional drilling machine further includes a blocking arrangement that automatically blocks one or more of the pockets of the feed structure.

9 Claims, 46 Drawing Sheets

FIG, 14b
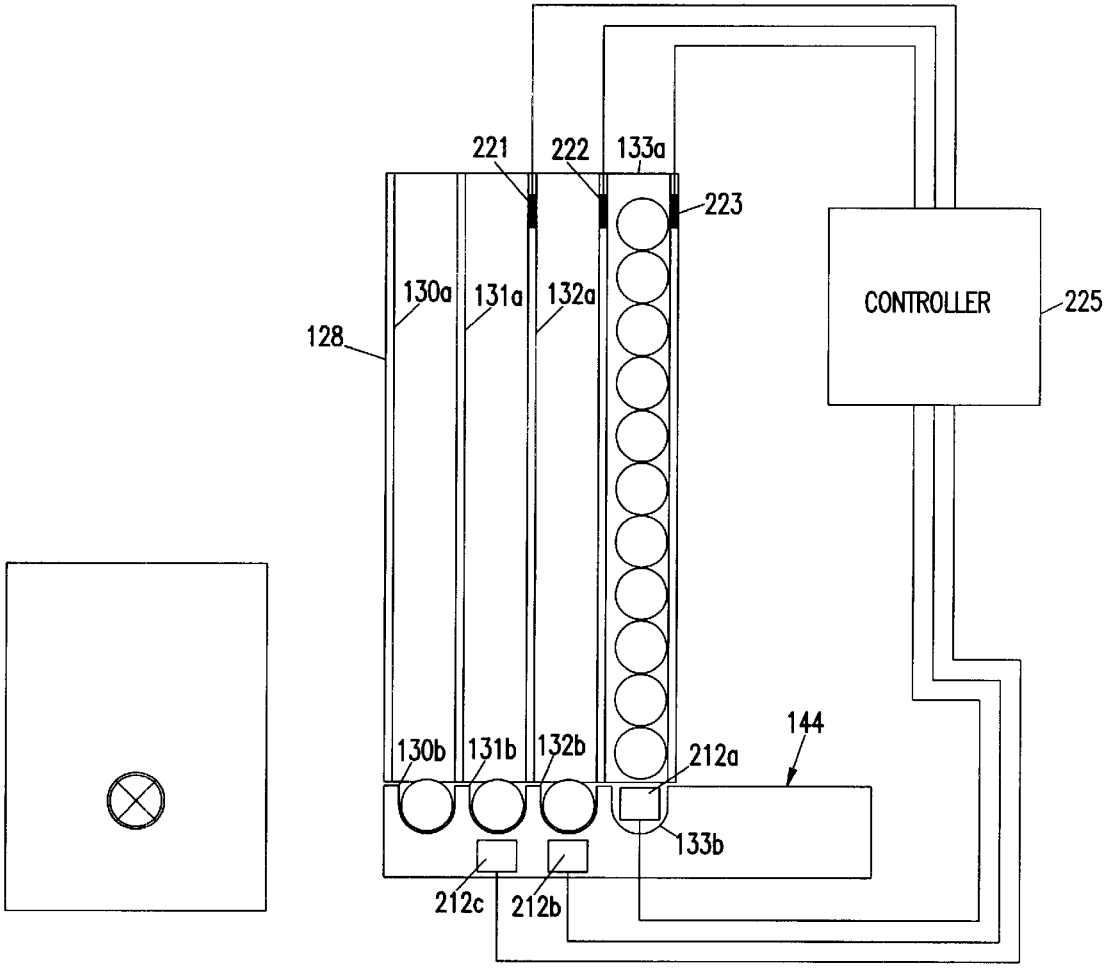

BLOCKING SYSTEM FOR A DIRECTIONAL DRILLING MACHINE

FIELD OF THE INVENTION

The present invention relates generally to underground drilling machines. More particularly, the present invention relates to rod loaders for feeding rods to and from horizontal directional drilling machines.

BACKGROUND OF THE INVENTION

Utility lines for water, electricity, gas, telephone and cable television are often run underground for reasons of safety and aesthetics. Sometimes, the underground utilities can be buried in a trench that is later back filled. However, trenching can be time consuming and can cause substantial damage to existing structures or roadways. Consequently, alternative techniques such as horizontal directional drilling (HDD) are becoming increasingly more popular.

A typical horizontal directional drilling machine includes a frame on which is mounted a drive mechanism that can be slidably moved along the longitudinal axis of the frame. The drive mechanism is adapted to rotate a drill string (i.e., a length of interconnected rods) about its longitudinal axis. Sliding movement of the drive mechanism along the frame, in concert with the rotation of the drill string, causes the drill string to be longitudinally advanced into or withdrawn from the ground.

In a typical horizontal directional drilling sequence, the horizontal directional drilling machine drills a hole into the ground at an oblique angle with respect to the ground surface. During drilling, drilling fluid can be pumped through the drill string, over a drill head (e.g., a cutting or boring tool) at the end of the drill string, and back up through the hole to remove cuttings and dirt. After the drill head reaches a desired depth, the drill head is then directed along a substantially horizontal path to create a horizontal hole. After the desired length of hole has been drilled, the drill head is then directed upwards to break through the ground surface. A pull-back sequence is then initiated. During the pull-back sequence, a reamer is attached to the drill string, and the drill string is pulled back through the hole. As the drill string is pulled back, the reamer enlarges the hole. It is common to attach a utility line or other conduit to the drill string so that it is dragged through the hole along with the reamer.

A typical horizontal directional drilling machine includes a rod box (i.e., a rack or magazine) for storing rods (i.e., pipes or other elongated members) used to make the drill strings. A rod transfer mechanism is used to transport rods between the drive mechanism of the directional drilling machine and the rod box. During a drilling sequence, the rod transfer mechanism transports rods from the rod box to the drive mechanism. During a pull-back sequence, the rod transfer mechanism transports rods from the drive mechanism back to the rod box.

U.S. Pat. No. 5,607,280 discloses a prior art rod handling device adapted for use with a horizontal directional drilling machine. As shown in FIG. 1, the rod handling device includes a rod box 24 having five vertical columns 41–45. Bottom ends of the columns 41–45 are open so as to define five separate discharge openings 41*a*–45*a* through which rods can be fed. A selection member 50 is mounted beneath the discharge openings 41*a*–45*a*. The selection member 50 has five pockets 41*b*–45*b*, and functions to index or feed rods 20 to and from the rod box 24. For example, during a drilling sequence, the selection member 50 indexes rods 20 from the rod box 24 to a pickup location where the rods are individually picked up and carried to a rotational drive head 16 of the drilling machine by a transfer arm 51. During a pull-back sequence, the transfer arm 51 carries rods 20 from the rotational drive head 16 back to the pickup location, and the selection member 50 indexes the rods from the pickup location back beneath the rod box 24. To move the rods from the selection member 50 back into the rod box, a lift is used to push pipes upwardly into the columns 51–54 of the rod box 24.

During a typical drilling sequence, the rod box is unloaded starting with column 45. After column 45 has been unloaded, column 44 is unloaded. Thereafter, column 43, column 42 and column 41 are sequentially unloaded. During a pull-back sequence (i.e., a sequence in which rods are transferred from the drive head 16 back to the rod box 24), the columns are typically sequentially loaded starting with column 45 and finishing with column 41. Once column 45 has been loaded, a block or plug is manually inserted into pocket 45*b* of the selection member 50 to prevent additional rods from being loaded into column 45. Thereafter, column 44 is loaded. Once column 44 has been filled, a plug or block is manually inserted into pocket 44*b* of the selection member 50 to prevent additional rods from being loaded into column 44. Column 43 is then loaded. After column 43 has been loaded, a block or plug is inserted into pocket 43*b* of the selection member to prevent additional rods from being loaded into column 43, and column 42 is loaded. Once column 42 has been fully loaded, a block or a plug is manually inserted into pocket 42*b* of the selection member 50 to prevent additional rods from being loaded into column 42, and column 41 is loaded.

SUMMARY OF THE INVENTION

One aspect of the present invention relates to a horizontal directional drilling machine including a magazine for holding a plurality of rods. The magazine includes a plurality of columns in which the rods are held. Each of the columns has a separate bottom opening. A feed structure is positioned beneath the magazine. The feed structure includes a plurality of upwardly opening pockets for receiving the rods from the columns. The horizontal directional drilling machine further includes one or more sensors that detect when predetermined numbers of rods have been loaded into the columns, and cause the blocking arrangement to block one or more of the pockets of the feed structure.

A variety of advantages of the invention will be set forth in part in the description that follows, and in part will be apparent from the description, or may be learned by practicing the invention. It is to be understood that both the foregoing general description and the following detailed description are explanatory only and are not restrictive of the invention as claimed.

BRIEF DESCRIPTION OF THE DRAWINGS

The accompanying drawings, which are incorporated in and constitute a part of the specification, illustrate several aspects of the invention and together with the description, serve to explain the principles of the invention. A brief description of the drawings is as follows:

FIGS. 14*b*–14*d* illustrate a rod loading sequence for the pocket blocking system of FIG. 14*a;*

DETAILED DESCRIPTION

With reference now to the various drawings in which identical elements are numbered identically throughout, a description of various exemplary aspects of the present invention will now be provided.

I. Overview of Directional Drilling Machine

Figure 1:
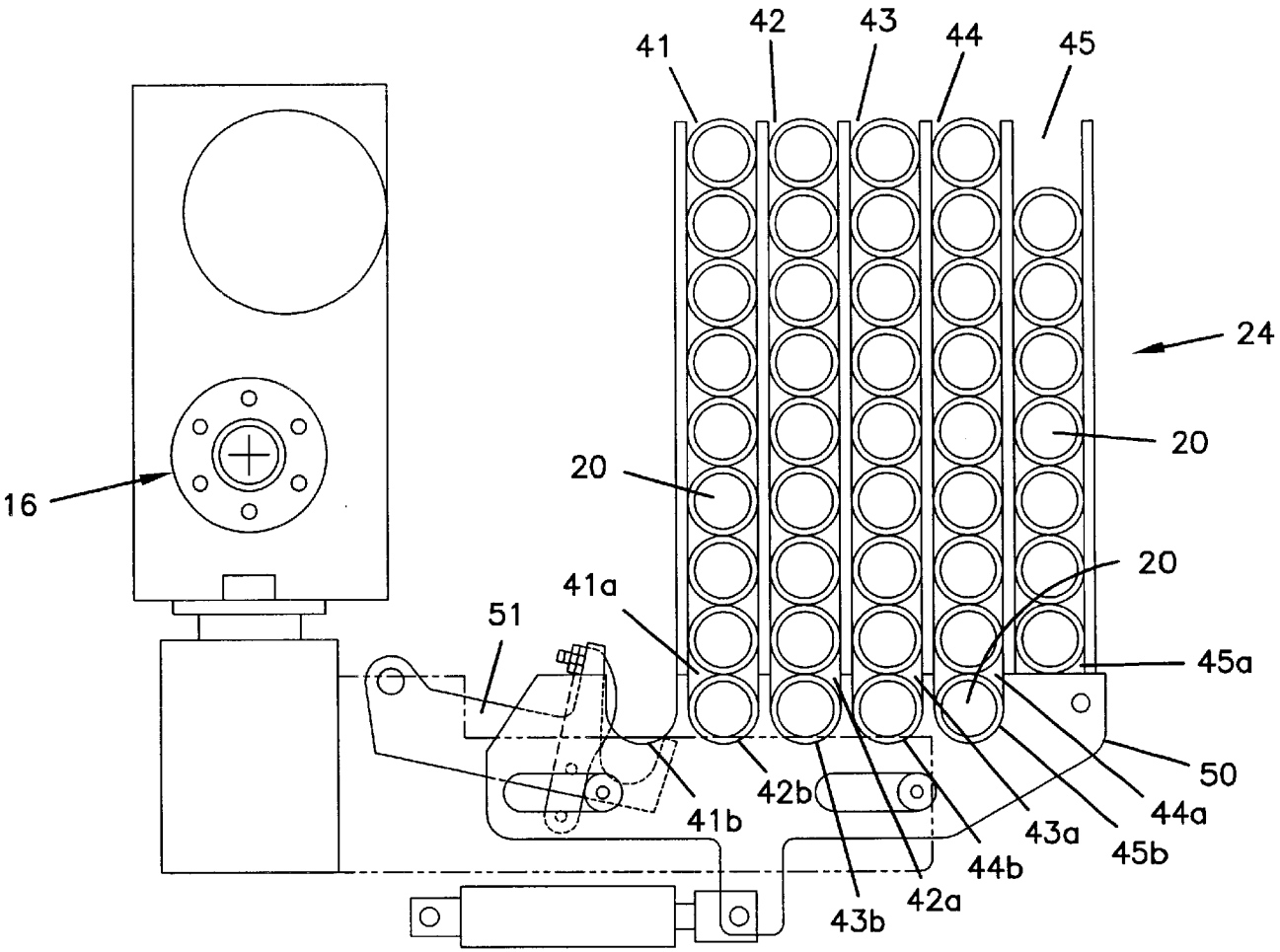
FIG. 1 illustrates a prior art rod handling apparatus.
Figure 2:
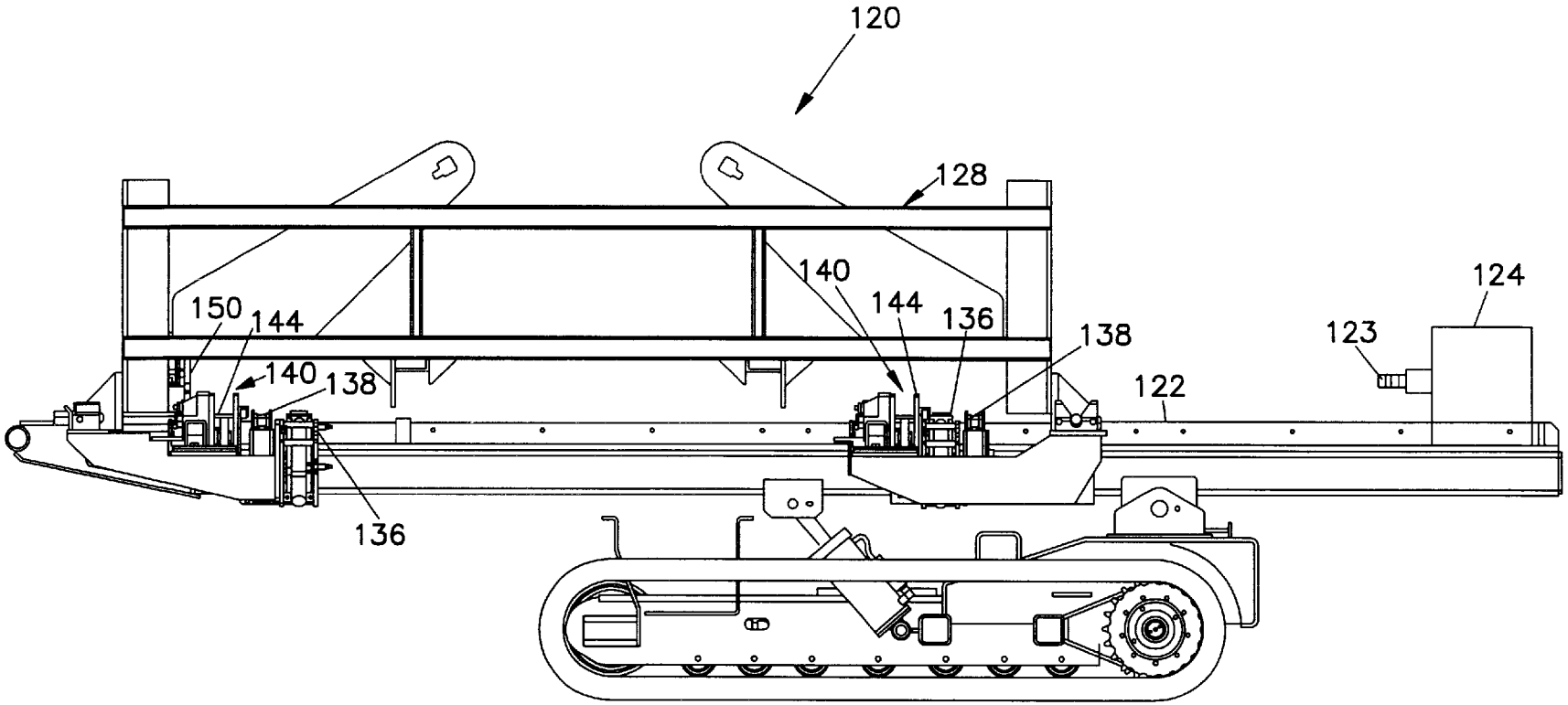
FIG. 2 is an elevational view of a horizontal directional drilling machine constructed in accordance with the principles of the present invention.
Figure 3:
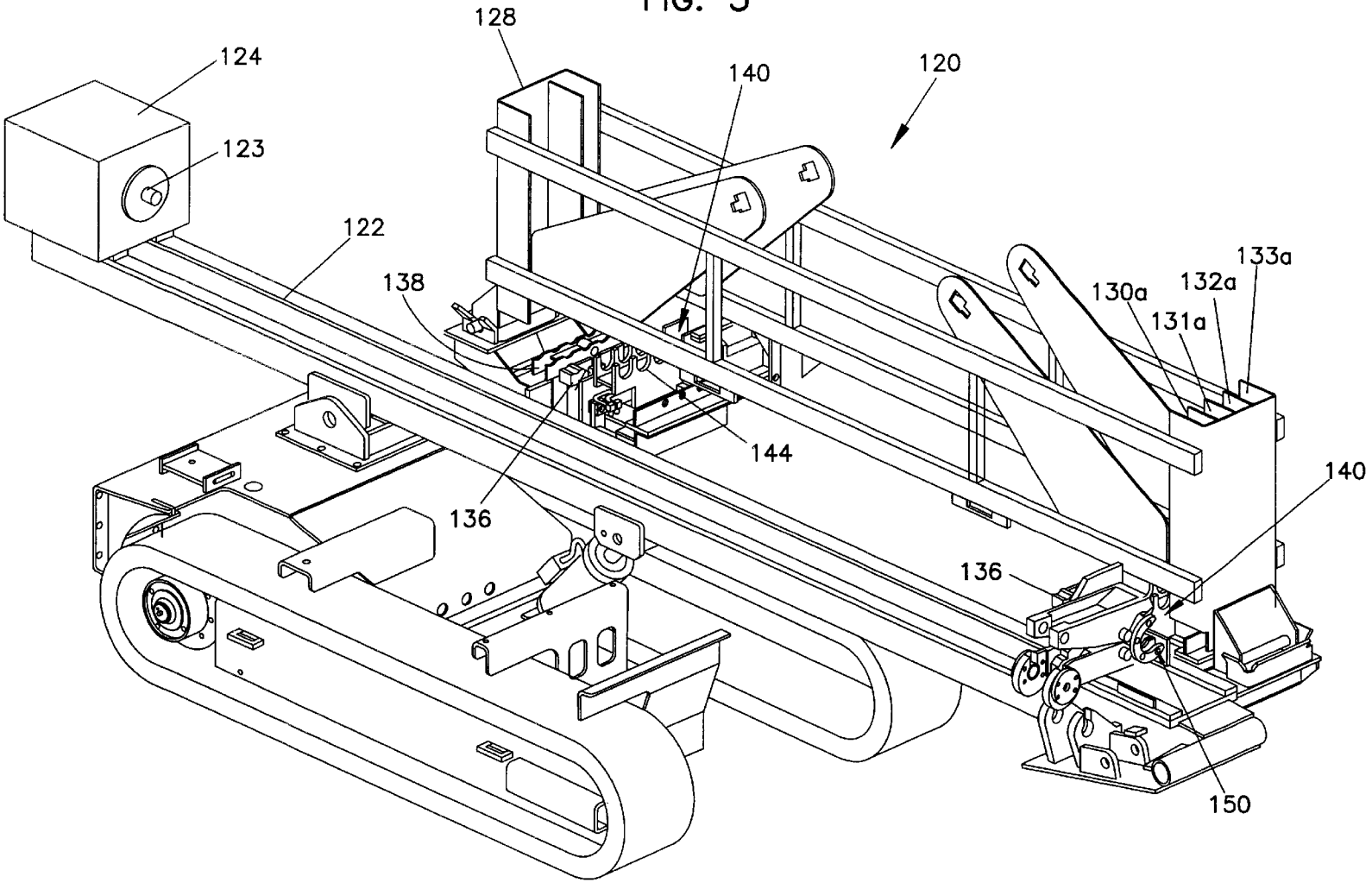
FIG. 3 is a perspective view of the horizontal directional drilling machine of FIG. 2.
Figure 4:
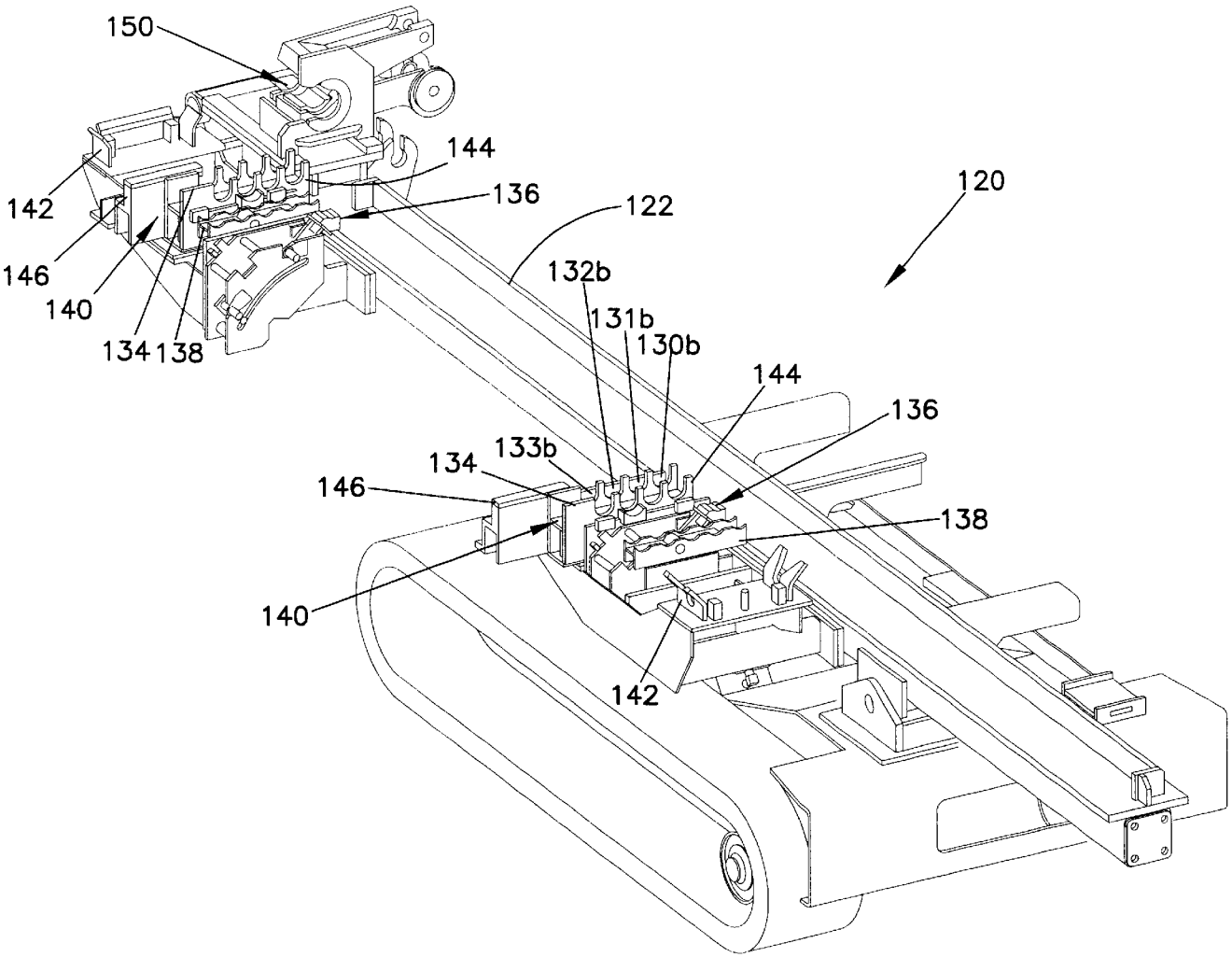
FIG. 4 is a perspective view of the horizontal directional drilling machine of FIG. 2 with the rod box removed.

FIGS. 2–4 illustrate a horizontal directional drilling machine 120 constructed in accordance with the principles of the present invention. The directional drilling machine 120 includes an elongated guide or track 122 that can be positioned by an operator at any number of different oblique angles relative to the ground. A rotational driver 124 (i.e., a drive head) is mounted on the track 122. The rotational driver 124 is adapted for rotating a drill string (i.e., a string of interconnected rods) in forward and reverse directions about a longitudinal axis of the drill string. The rotational driver 124 includes a drive chuck 123 for connecting the rotational driver to the drill string. Gripping units 150 (e.g., vice grips or wrenches) are provided adjacent the track 122 for use in coupling and uncoupling rods to the drive chuck 123. A thrust mechanism (not shown) is provided for: 1) pushing the rotational driver 124 down the track 122 to push a drill string into the ground during drilling operations; and 2) pulling the rotational driver 124 up the track 122 to pull a drill string from the ground during reaming/pull-back operations.

It will be appreciated that the above-described components are well known in the art and can have any number of different configurations. Exemplary prior art machines including such components are manufactured by Vermeer Manufacturing Company of Pella, Iowa.

Referring again to FIGS. 2 and 3, the horizontal directional drilling machine 120 also includes a removable rod box 128 (i.e., a magazine or rack) for storing the drilling rods. As best shown in FIG. 3, the rod box 128 defines four separate vertical rod storage columns 130*a*–133*a*. Each of the columns 130*a*–133*a* has an open lower end for allowing rods to be discharged from the rod box 128 and/or for allowing rods to be loaded back into the rod box 128. While four columns have been shown, it will be appreciated that the number of columns can be varied without departing from the principles of the present invention.

As best shown in FIGS. 3 and 4, the directional drilling machine 120 also includes a cycling apparatus for feeding rods to and from the rod box 128. The cycling apparatus includes two indexing assemblies 140. A shown in FIG. 3, the indexing assembles 140 are positioned so as to be located beneath opposite ends of the rod box 128 when the rod box 128 is mounted on the directional drilling machine 120. Alignment structures 142 are provided on the directional drilling machine 120 for aligning the rod box 128 relative to the indexing assemblies 140.

The indexing assemblies 140 each include a feed structure 144 (i.e., an indexing member or a feed member) and a blocking structure 146. Each of the feed structures 144 includes a plurality of upwardly opening pockets. Preferably, the number of pockets provided on each feed structure 144 is equal to the number of columns provided in the rod box 128. For example, as shown in FIG. 4, each feed structure 144 includes four pockets 130*b*–133*b* corresponding to the four columns 130*a*–133*a* of the rod box 128. The pockets 130*b*–133*b* are sized for receiving and holding rods. Each of the feed structures 144 also includes a blocking element 134 positioned adjacent to the pocket 133*b* or within the feed structure 144.

The feed structures 144 are used to feed rods out from beneath the rod box 128 during drilling operations, and also used to feed rods back under the rod box 128 during pull-back operations. A pair of transfer mechanisms 136 are provided for transferring rods between the feed structures 144 and the gripping units 150 of the directional drilling machine 120. It will be appreciated that the transfer mechanisms can have a variety of configurations. The directional drilling machine 120 further includes a pair of lifts 138 for lowering rods from the rod box 128 to the feed structures 144, and also for lifting rods from the feed structure 144 to the rod box 128.

II. Sequence for Transferring Rods from Rod Box to Rotational Driver

Figure 5A:
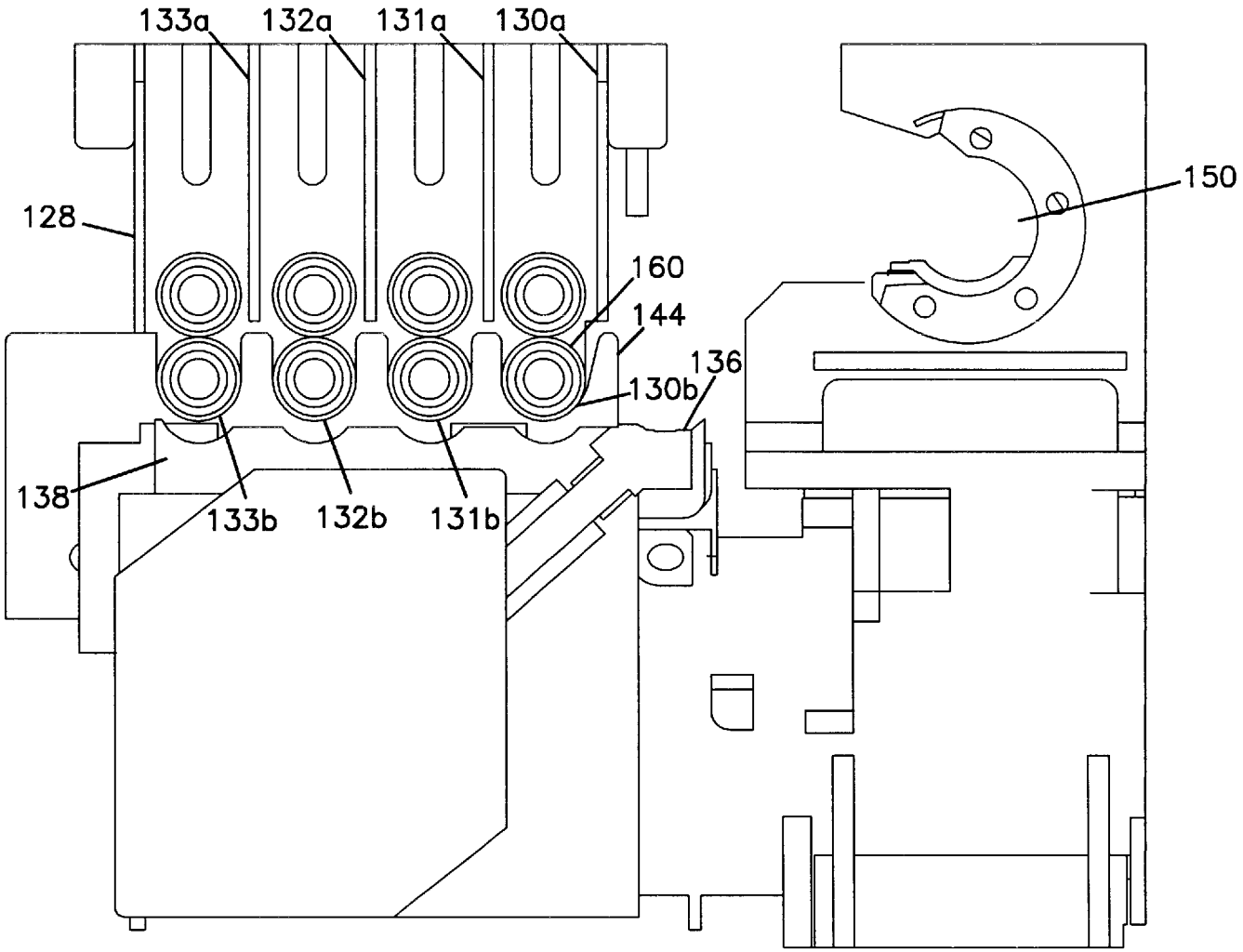
FIGS. 5*a*–5*g* illustrate a rod transfer sequence for moving a rod from the magazine to the rotational drive head of the horizontal directional drilling machine of FIG. 2.

FIGS. 5*a*–5*g* illustrate a transfer sequence for moving rod 160 from the rod box 128 to the gripping units 150 during a drilling operation. In FIG. 5*a,* rod 160 is located within pockets 130*b* of the feed structures 144, and the feed structures 144 are oriented in a retracted position in which pockets 130*b*–133*b* are positioned directly beneath respective columns 130*a*–133*a* . Also, the lifts 138 are lowered, and the rod transfer mechanisms 136 are retracted.

Figure 5B:
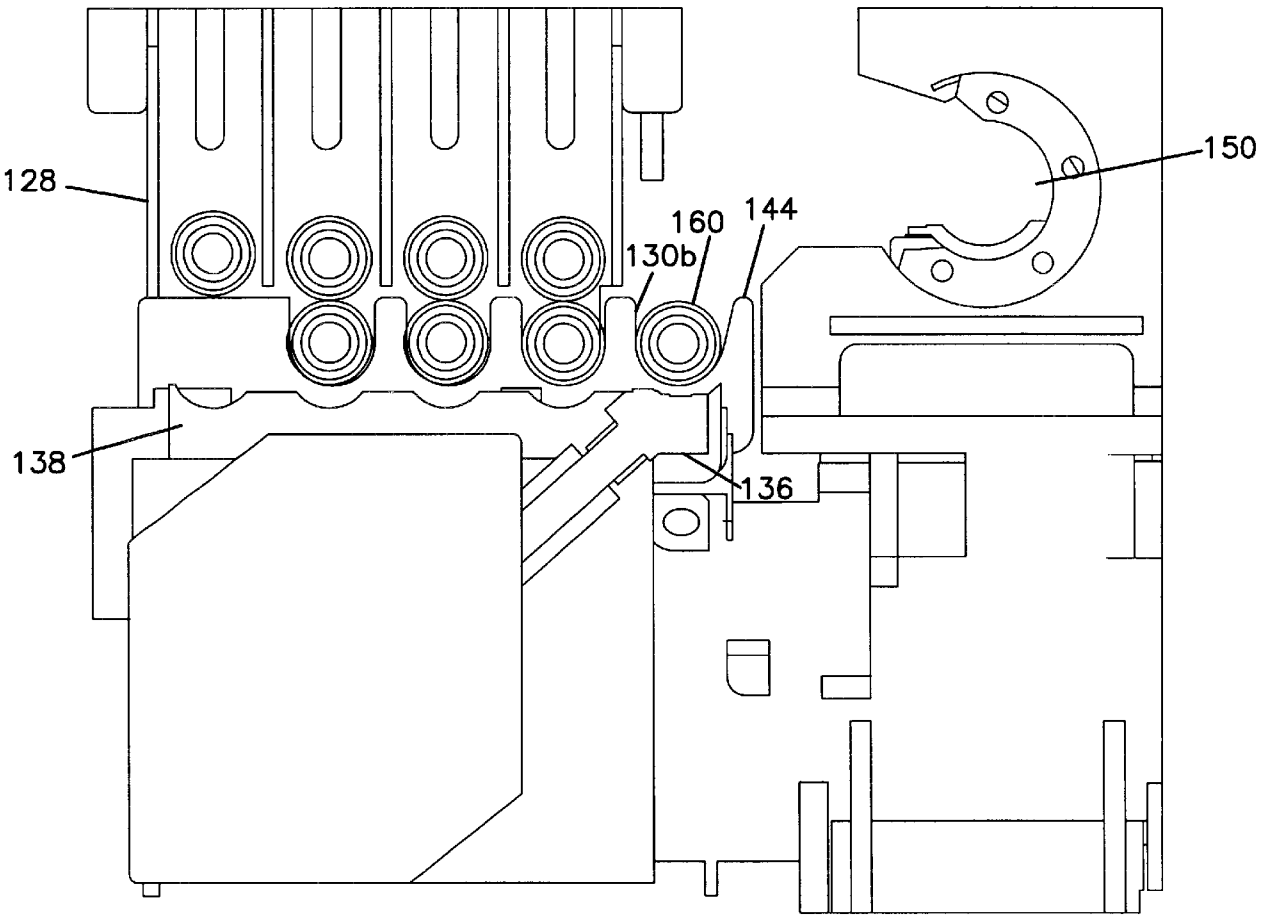
Figure 5C:
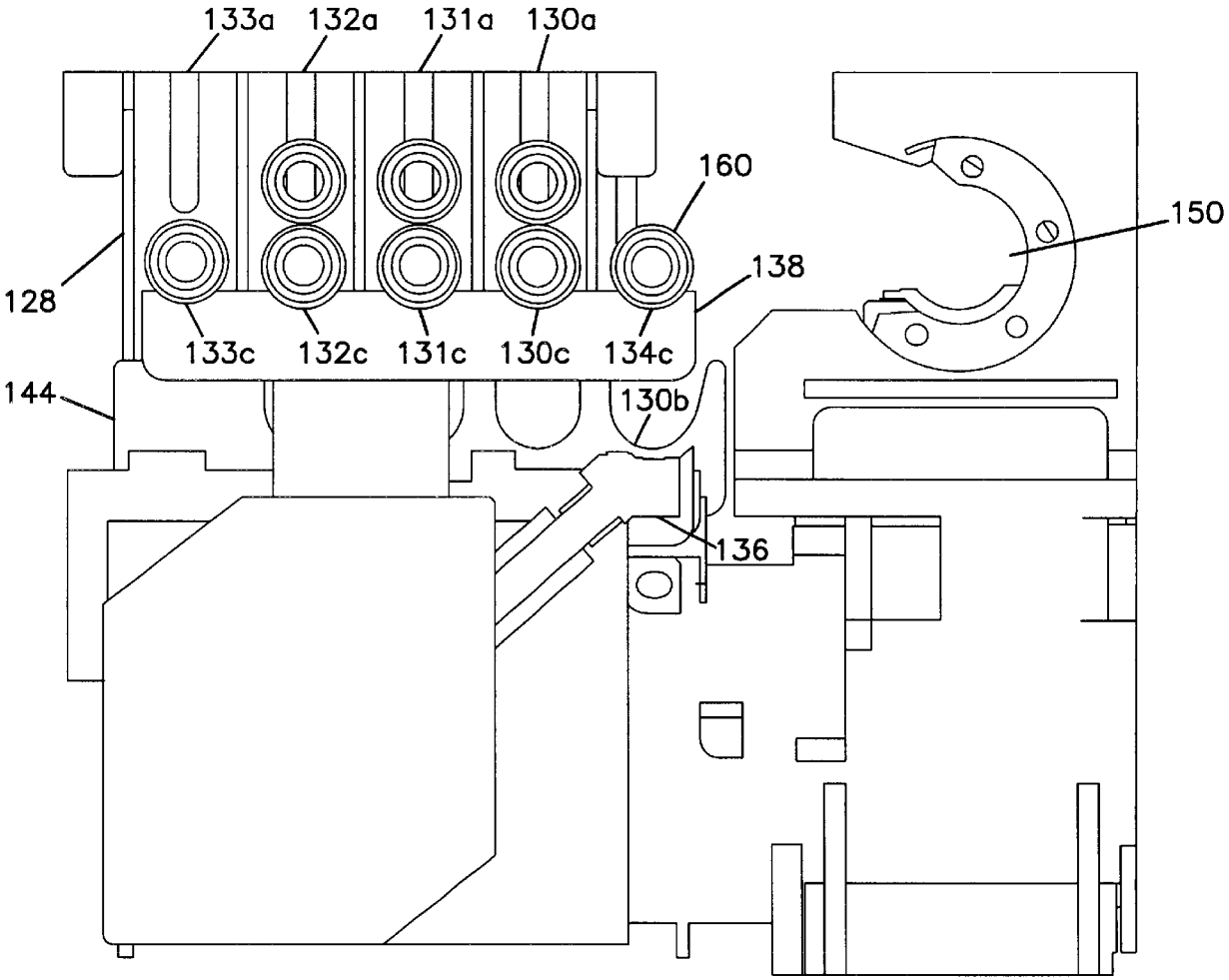
Figure 5D:
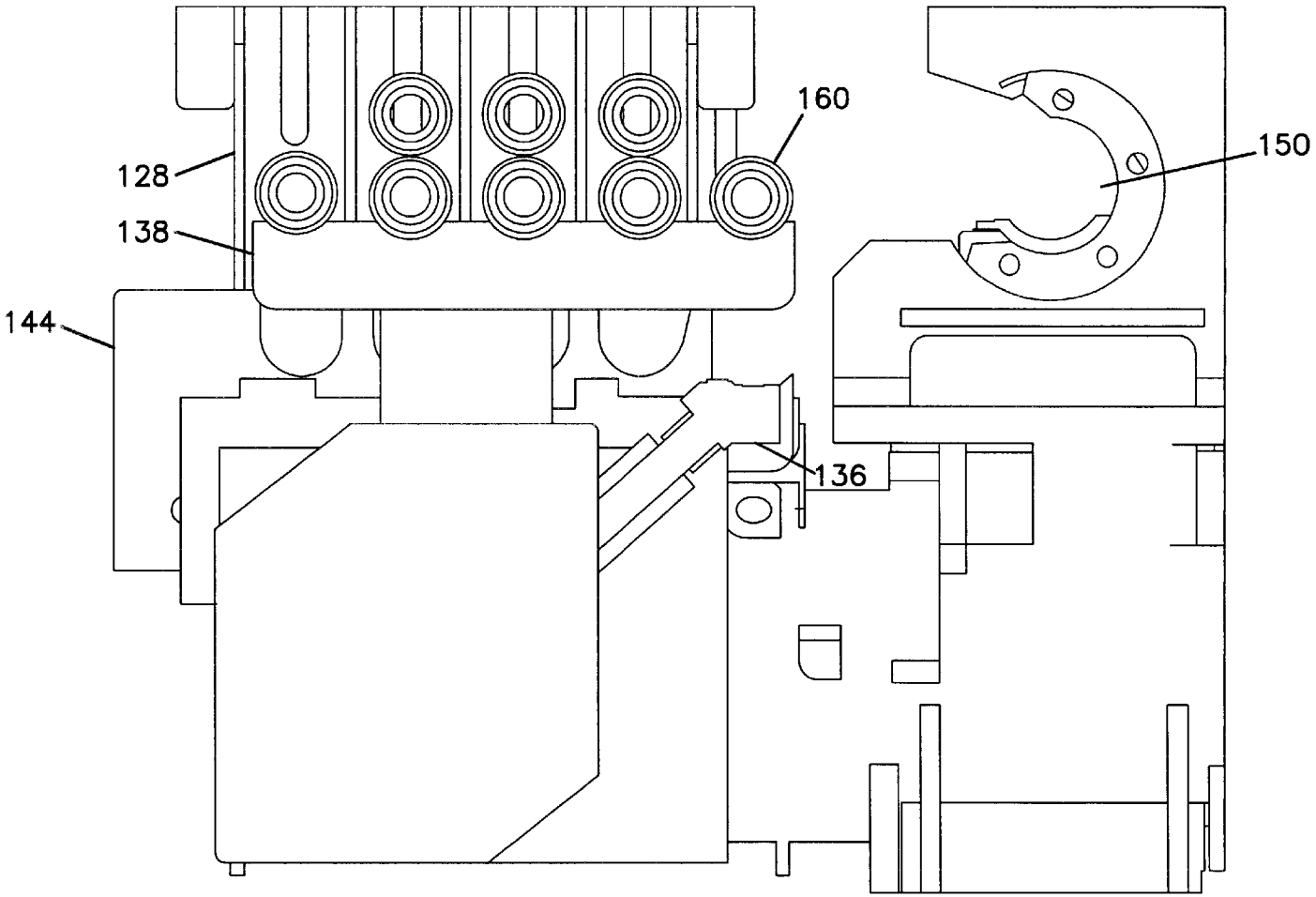
Figure 5E:
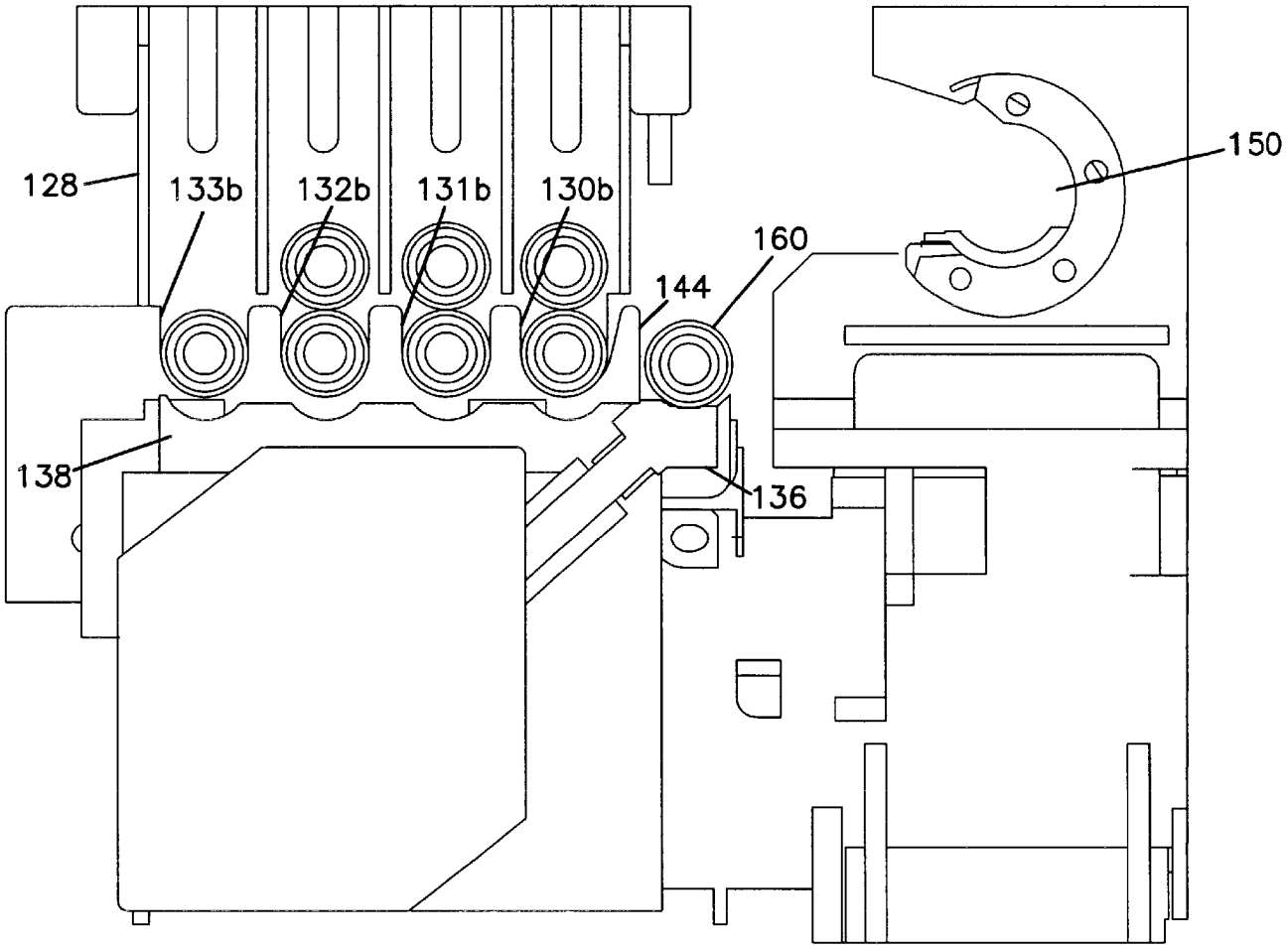
Figure 5F:
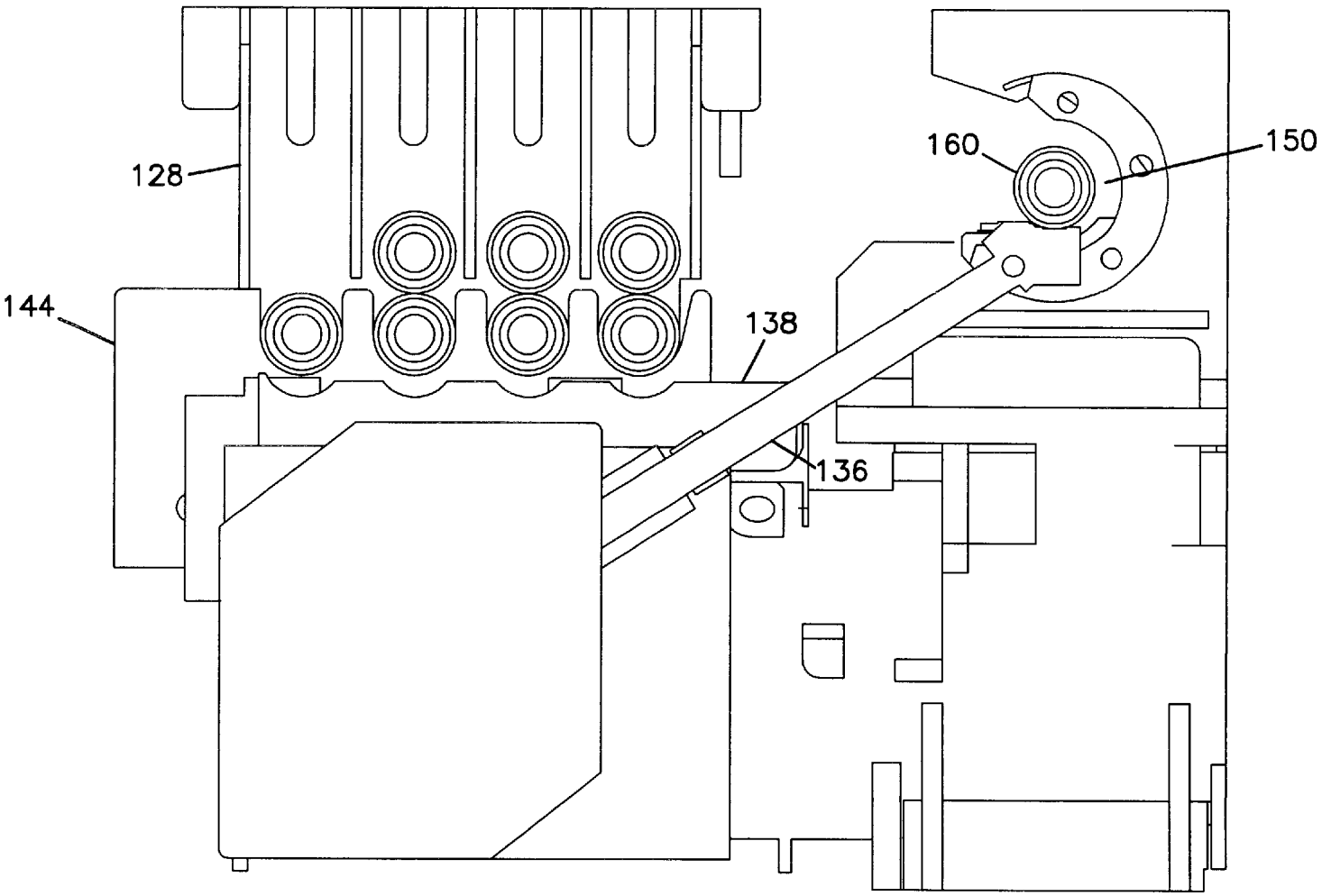
Figure 5G:
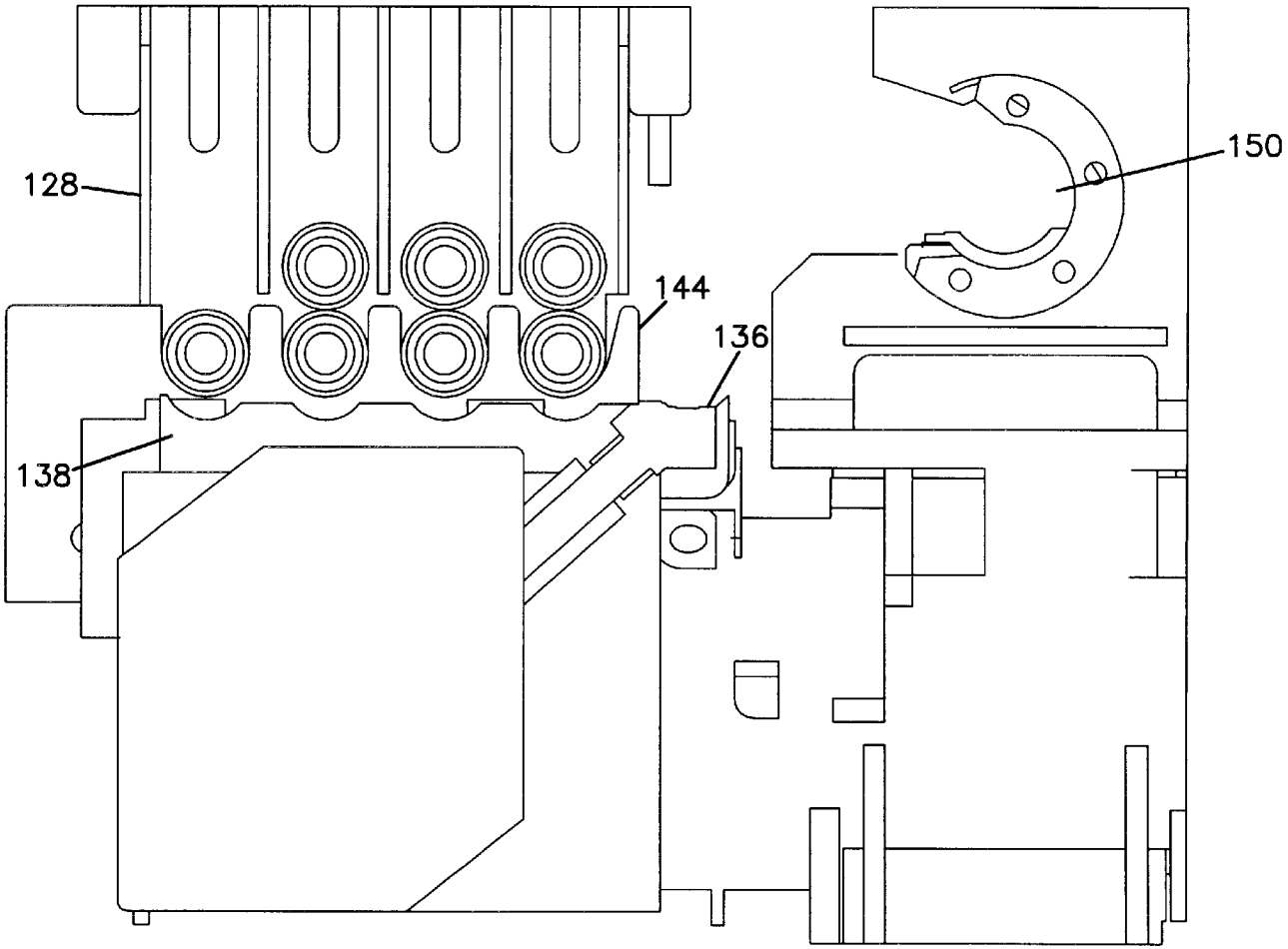

To initiate the transfer sequence, the feed structures 144 are moved from the retracted position of FIG. 5*a* to an extended position as shown in FIG. 5*b*. The distance between the retracted position and the extended position is preferably about one column width. In the extended position, the pockets 130*b* are no longer positioned beneath the rod box 128. With the feed structures 144 extended, the lifts 138 are raised as shown in FIG. 5*c*. By raising the lifts 138, the rods of the rod box 128 are lifted from the pockets 130*b*–133*b* . With the lifts 138 raised, the feed structures 144 are the retracted as shown in FIG. 5*d*. Next, the lifts 138 are lowered such that the lowermost rods within the rod box 128 are placed in the pockets 130*b*–133*b,* and rod 160 is placed into engagement with the transfer mechanisms 136 (see FIG. 5*e*). Thereafter, the transfer mechanisms 136 are extended to place rod 160 in the gripping units 150 as shown in FIG. 5*f*. With rod 160 so positioned, the gripping units 150 hold rod 160 in axial alignment with the drive chuck 123 of the rotational driver 124. Rod 160 is also held in axial alignment with a drill string that may have already been drilled into the ground. As so aligned, rod 160 can be coupled to both the rotational driver 124 and the drill string thereby enabling rod 160 to be propelled into the ground. Finally, the transfer mechanisms 136 are retracted as (shown in FIG. 5*g*), and the cycle can be repeated to transfer the next rod (i.e., the rod held within pocket 130*b*) to the drill string.

III. Sequence for Transferring Rods from Rotational Driver to Rod Box

Figure 6A:
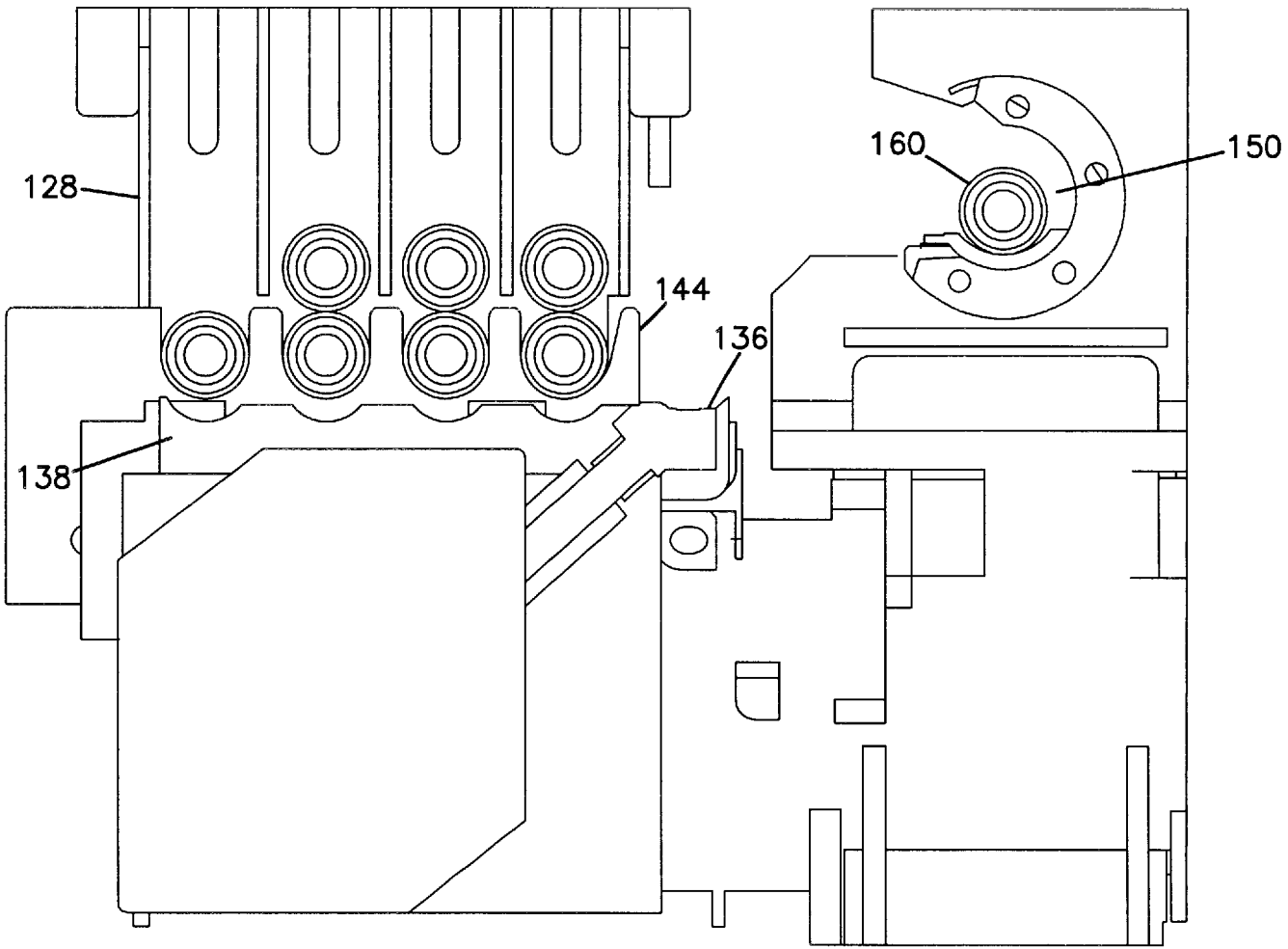
FIGS. 6*a*–6*g* illustrate a rod transfer sequence for moving a rod from the rotational drive head to the magazine of the horizontal directional drilling machine of FIG. 2.
Figure 6B:
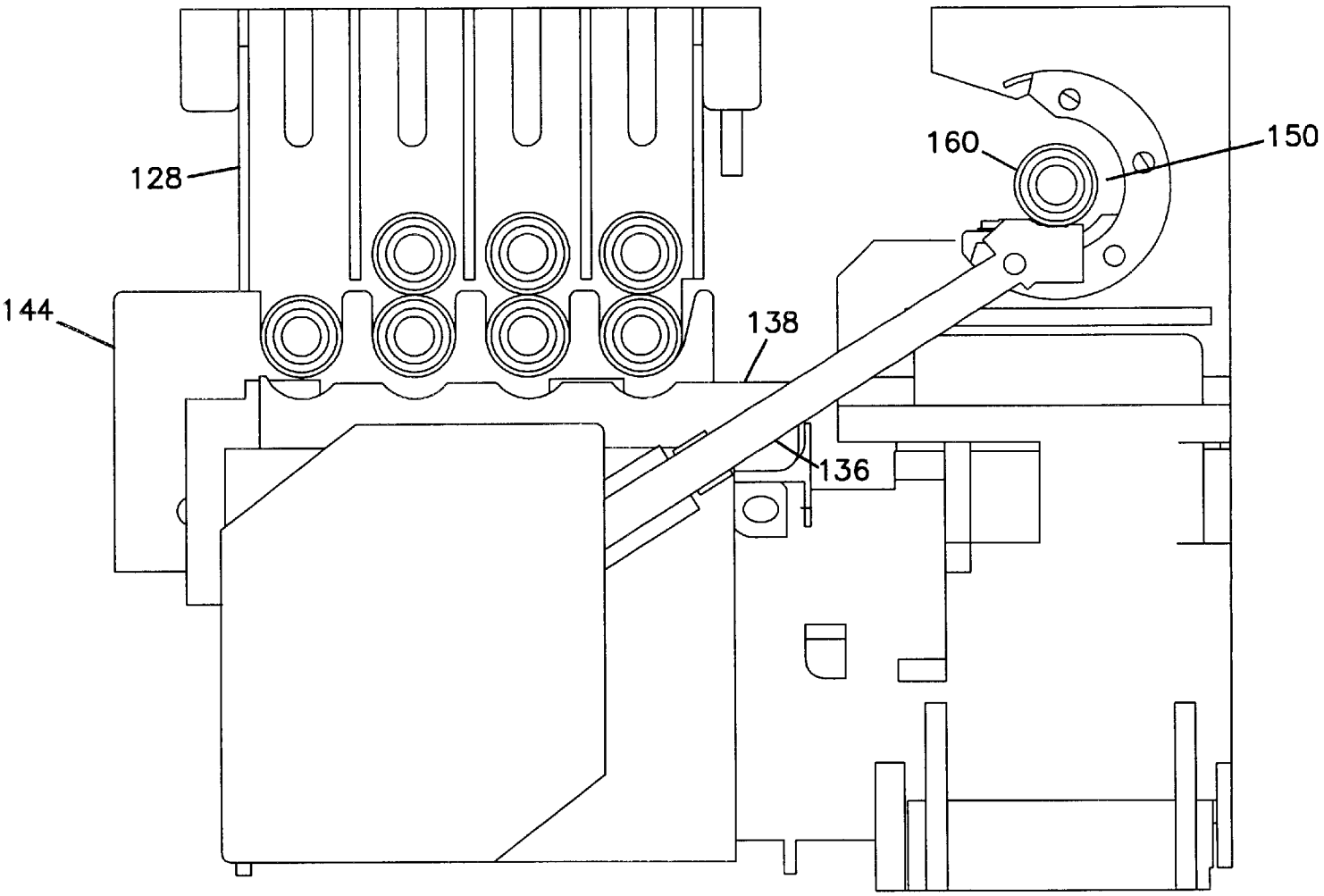
Figure 6C:
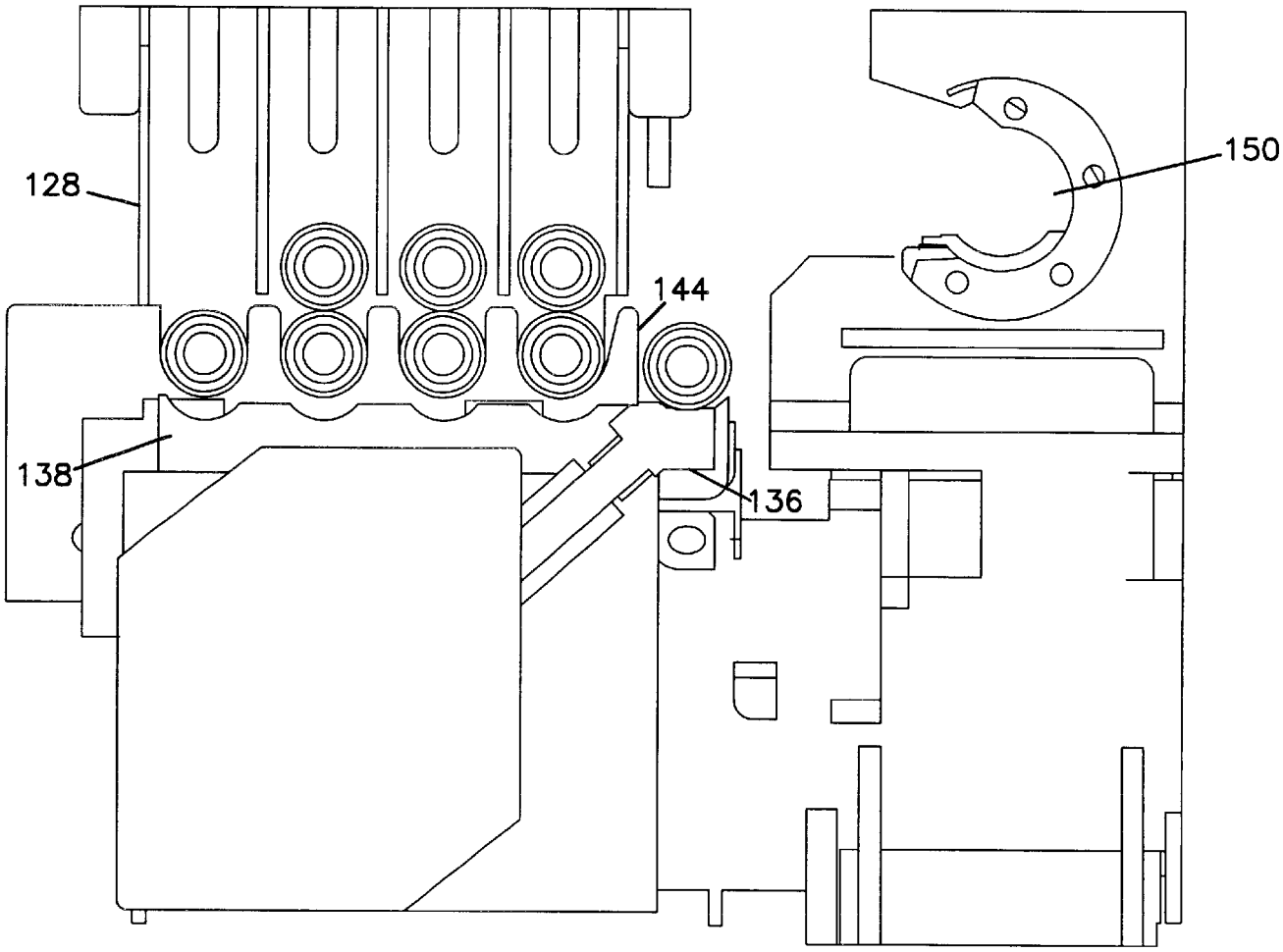
Figure 6D:
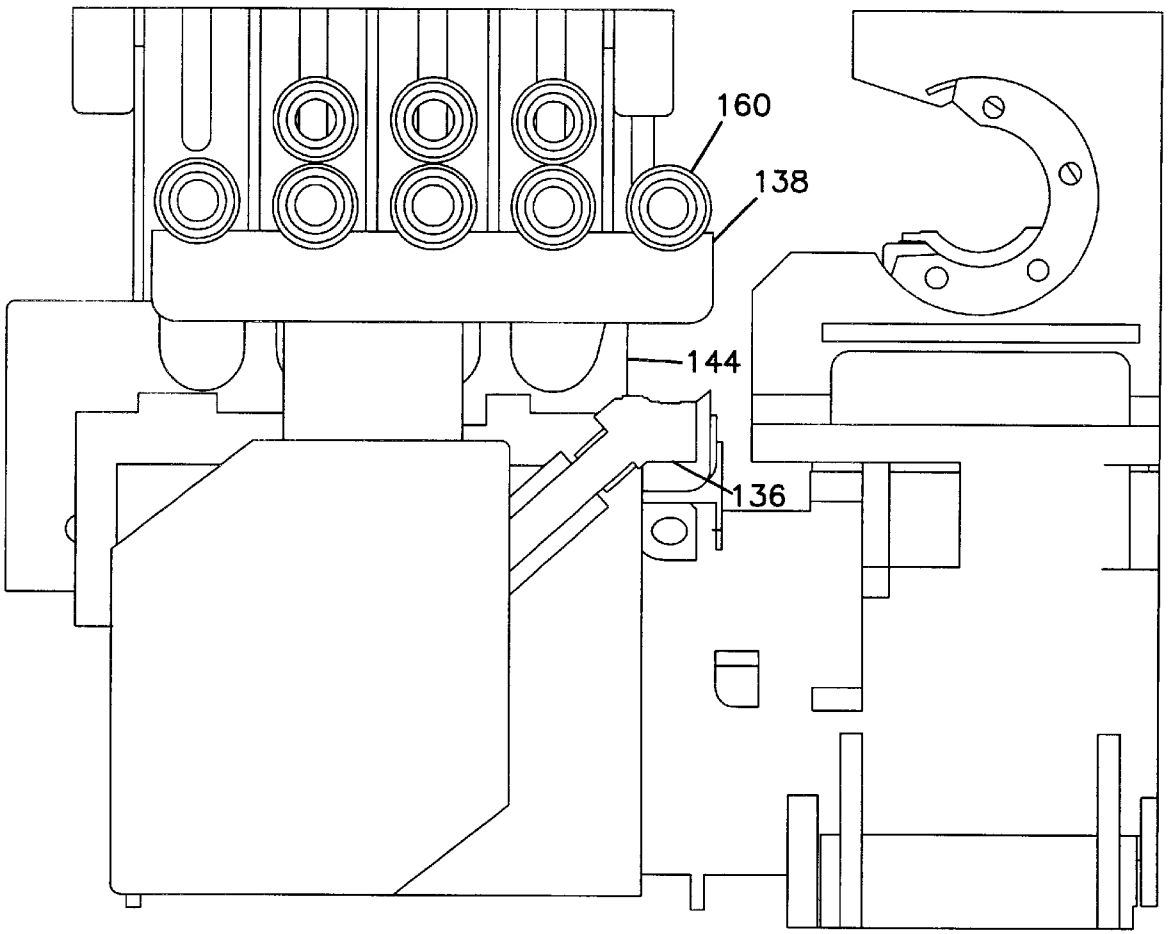
Figure 6E:
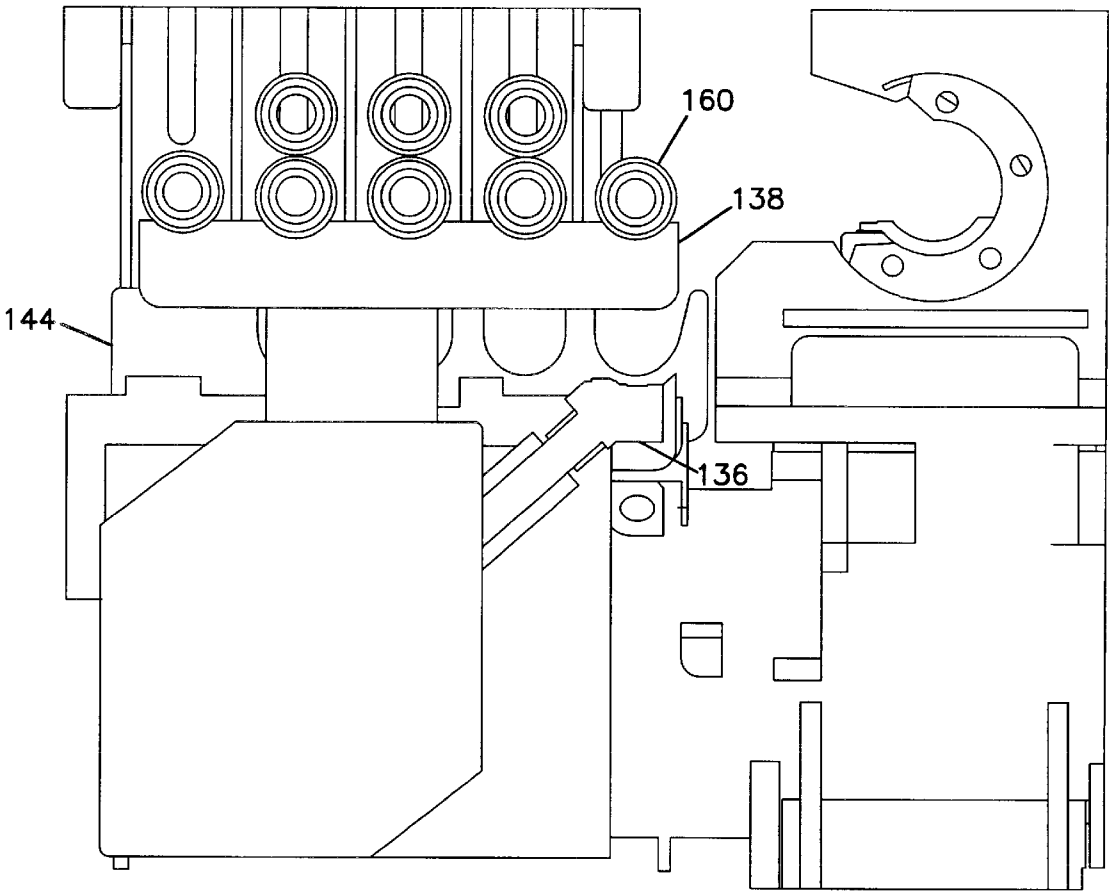
Figure 6F:
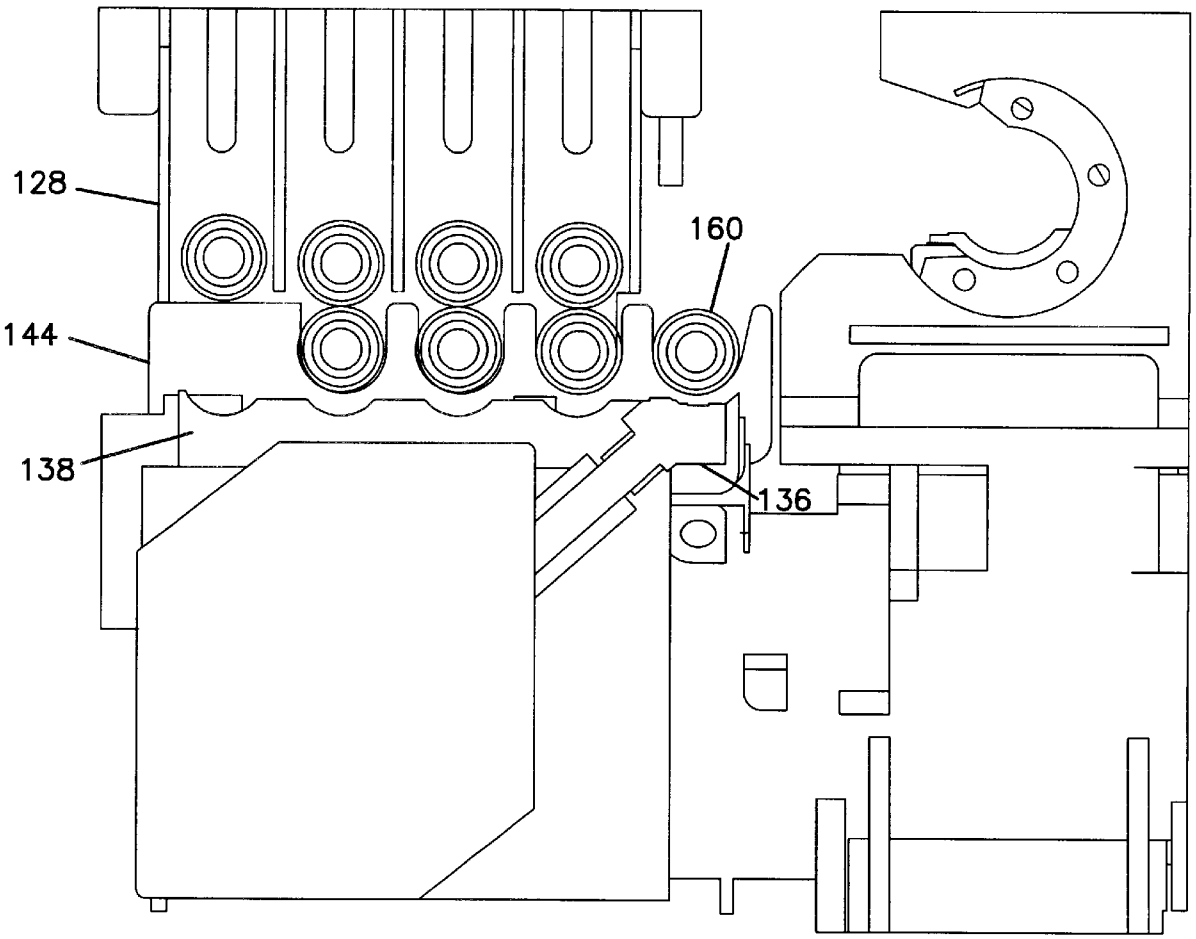
Figure 6G:
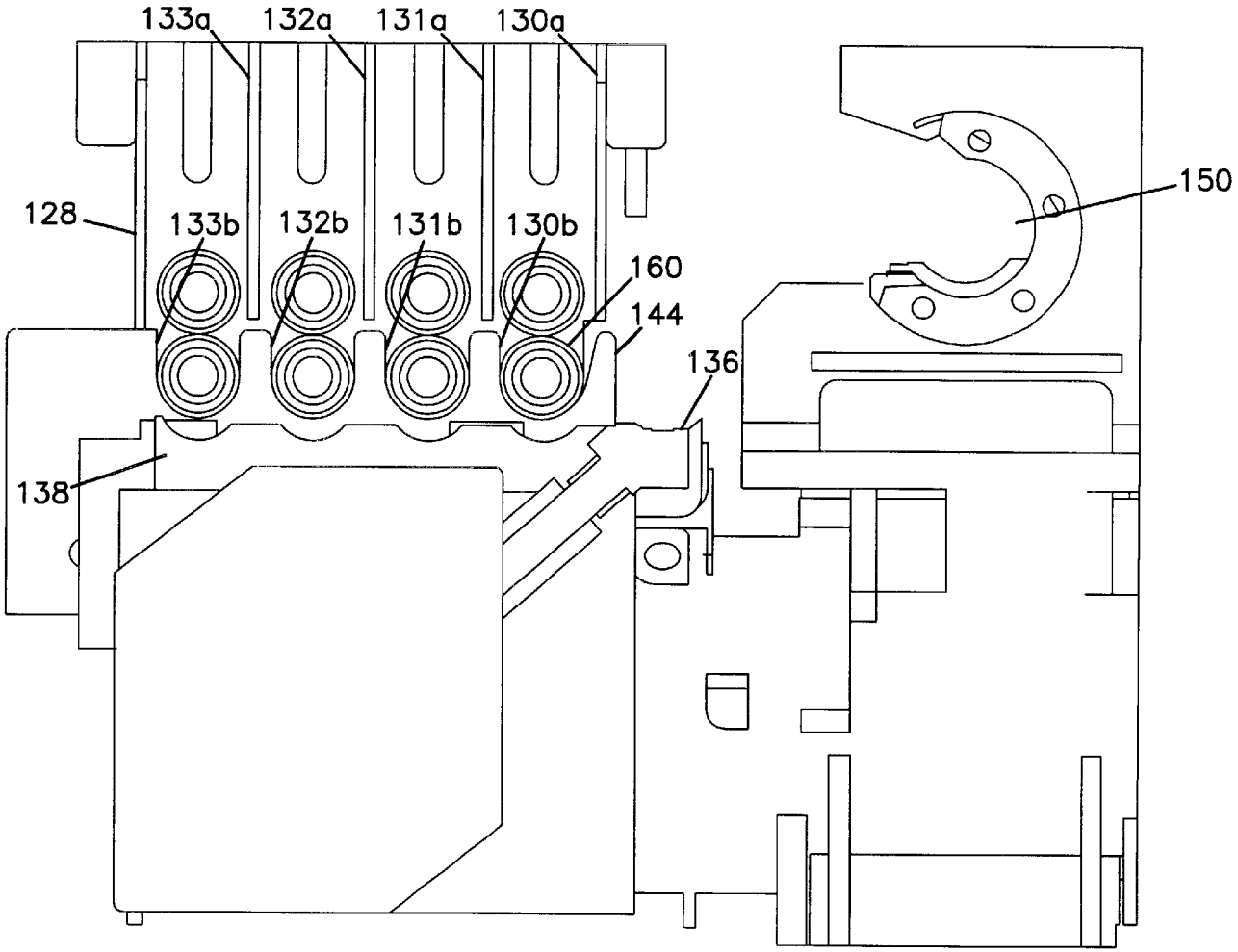

FIGS. 6*a*–6*g* illustrate a transfer sequence for transferring rod 160 from the drill string back to the rod box 128 during a pull-back sequence. As shown in FIG. 6*a,* rod 160 is located at the gripping units 150, the feed structures 144 and the transfer mechanisms 136 are retracted, and the lifts 138 are lowered. To initiate the sequence, the transfer mechanisms 136 are extended to engage rod 160 as shown in FIG. 6*b*. Next, the transfer mechanisms 136 are retracted as shown in FIG. 6*c*. Subsequently, the lifts 138 are raised thereby clearing the rods from the feed structures 144 as shown in FIG. 6*d*. With the rods raised, the feed structures 144 are moved from the retracted orientation to the extended orientation as shown in FIG. 6*e*. Thereafter, the lifts 138 are lowered thereby lowering the rods into the pockets 130*b*–133*b* of the feed structures 144 (see FIG. 6*f*). After the lifts 138 have been lowered, the feed structures 144 are retracted such that the pockets 130*b*–133*b* align beneath the columns 130*a*–133*a* as shown in FIG. 6*g*. Finally, the lifts 138 can again be raised to lift all of the rods into the rod box 128. The sequence is repeated to load additional rods into the rod box 128.

IV. Lift Apparatus

Figure 7:
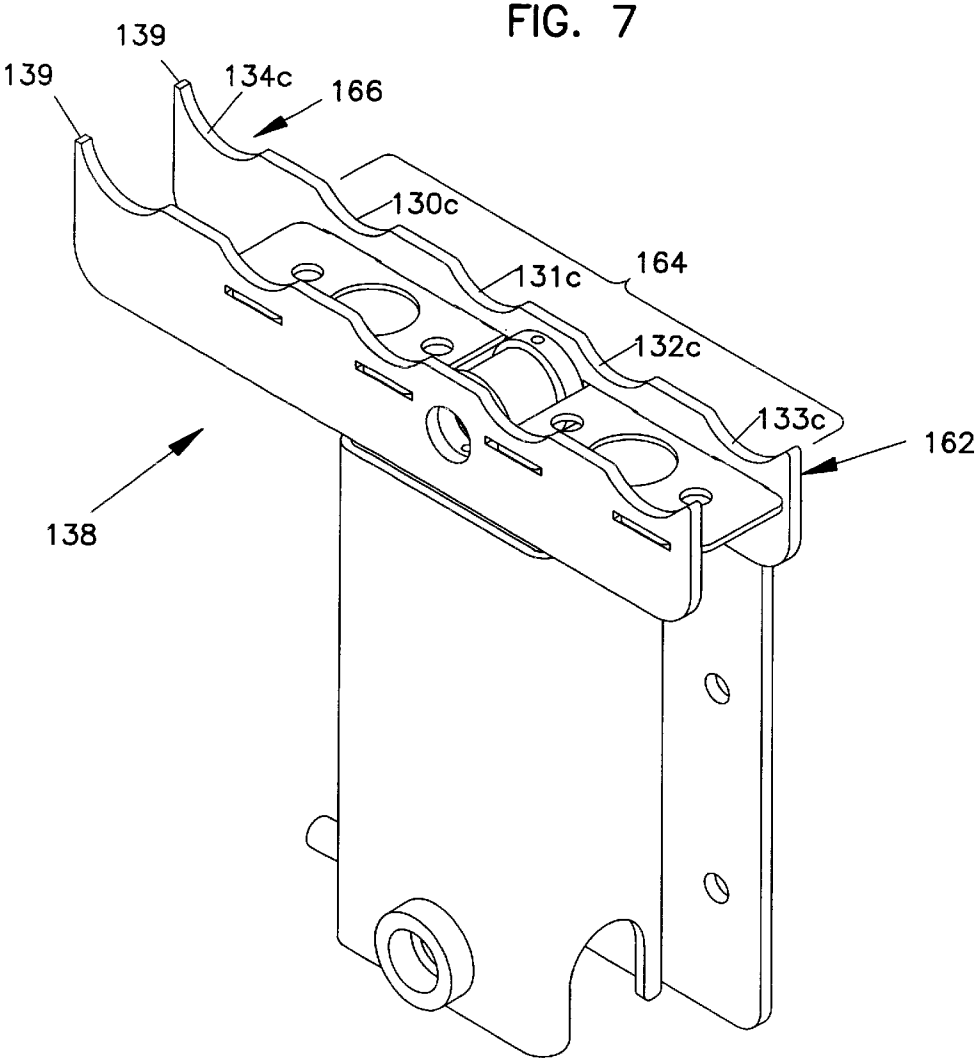
FIG. 7 illustrates a rod lift used by the horizontal directional drilling machine of FIG. 2.

FIG. 7 shows one of the lifts 138 in isolation from the horizontal directional drilling machine 120. The depicted lift 138 can be raised and lowered by any number of conventional structures. For example, one or more hydraulic cylinders can be used to raise and lower the lift 138. The lift 138 includes a top piece 162 having a first portion 164 and a second portion 166. The first portion 164 is adapted to align beneath the rod box 128, and the second portion 166 is adapted to extend laterally outward beyond the bottom of the rod box 128. The first portion 164 defines four rod cradling recesses 130*c*–133*c,* and the second portion 166 also defines a rod cradling recess 134*c*. When the rod box 128 is mounted on the directional drilling machine 120, as shown in FIG. 5*c,* the pipe cradling recesses 130*c*–133*c* respectively align with the columns 130*a*–133*a* of the rod box 128, and the recess 134*c* is laterally offset from the rod box 128. The location of the rod holding recess structure 134*c* facilitates its use as a rod staging location for temporarily holding rods as they are transferred between the feed structures 144 and the transfer mechanisms 136.

While recesses has been shown for holding or cradling rods on the top piece 162 of the lift 138, it will be appreciated that other structures for retaining rods (e.g., lips, mechanical grippers, flanges, fingers, etc.) can also be used. For example, optional stops 139 can be used. Additionally, a fixed stop (e.g., a wall or barrier) attached to the frame at a location adjacent to the end of the second portion 166 could also be used.

V. Rod Transfer Mechanism

Figure 8:
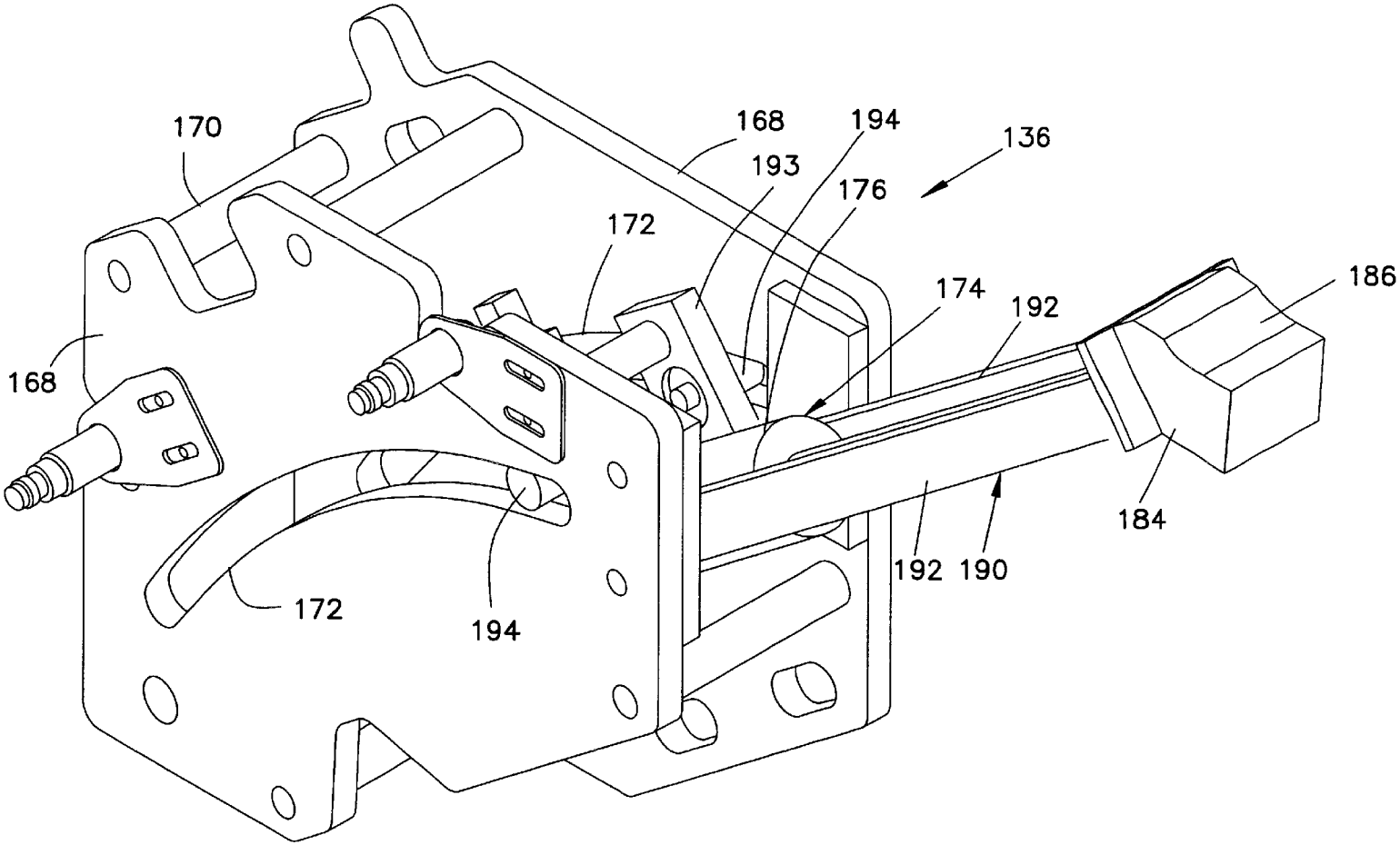
FIG. 8 is a perspective view of a rod transfer mechanism used by the horizontal directional drilling machine of FIG. 2.
Figure 9:
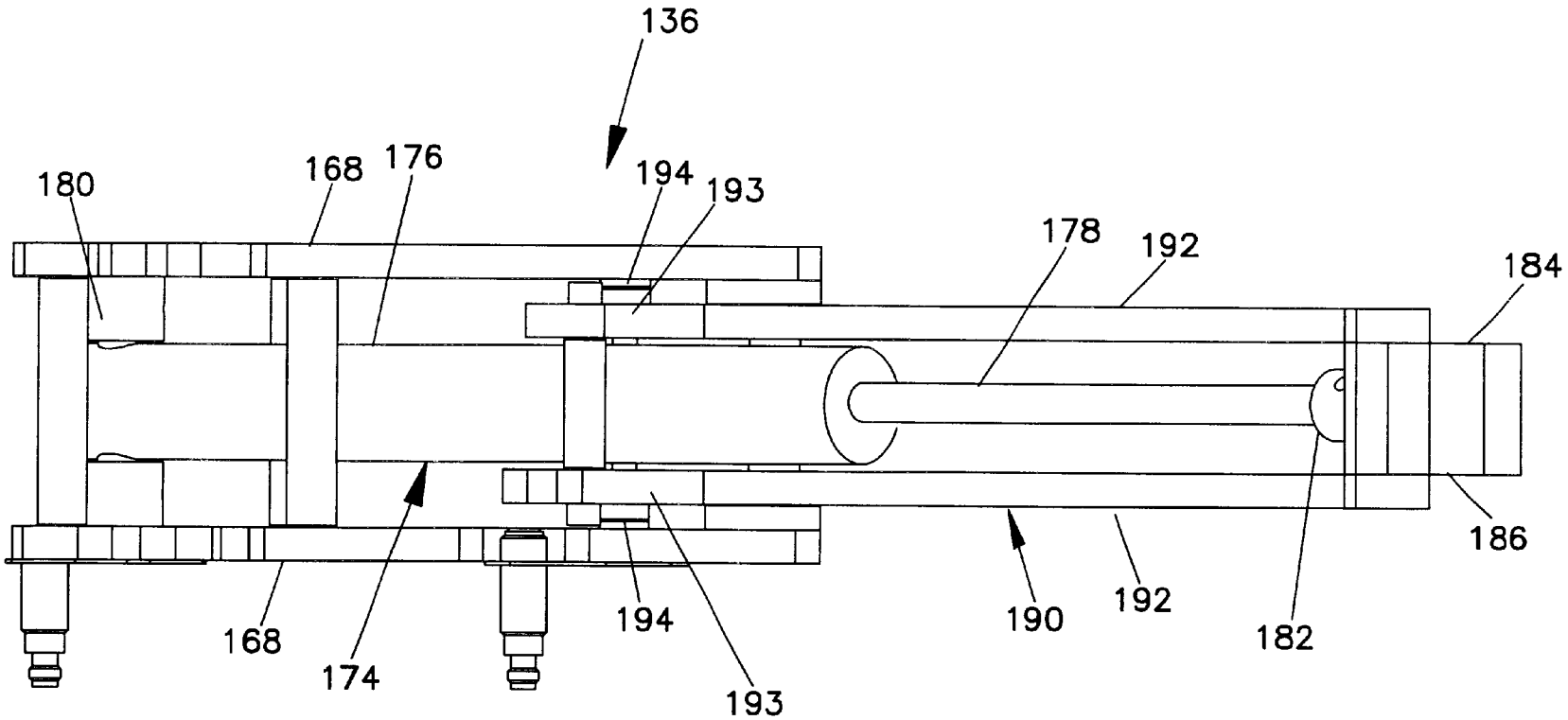
FIG. 9 is a top plan view of the rod transfer mechanism of FIG. 8.
Figure 10A:
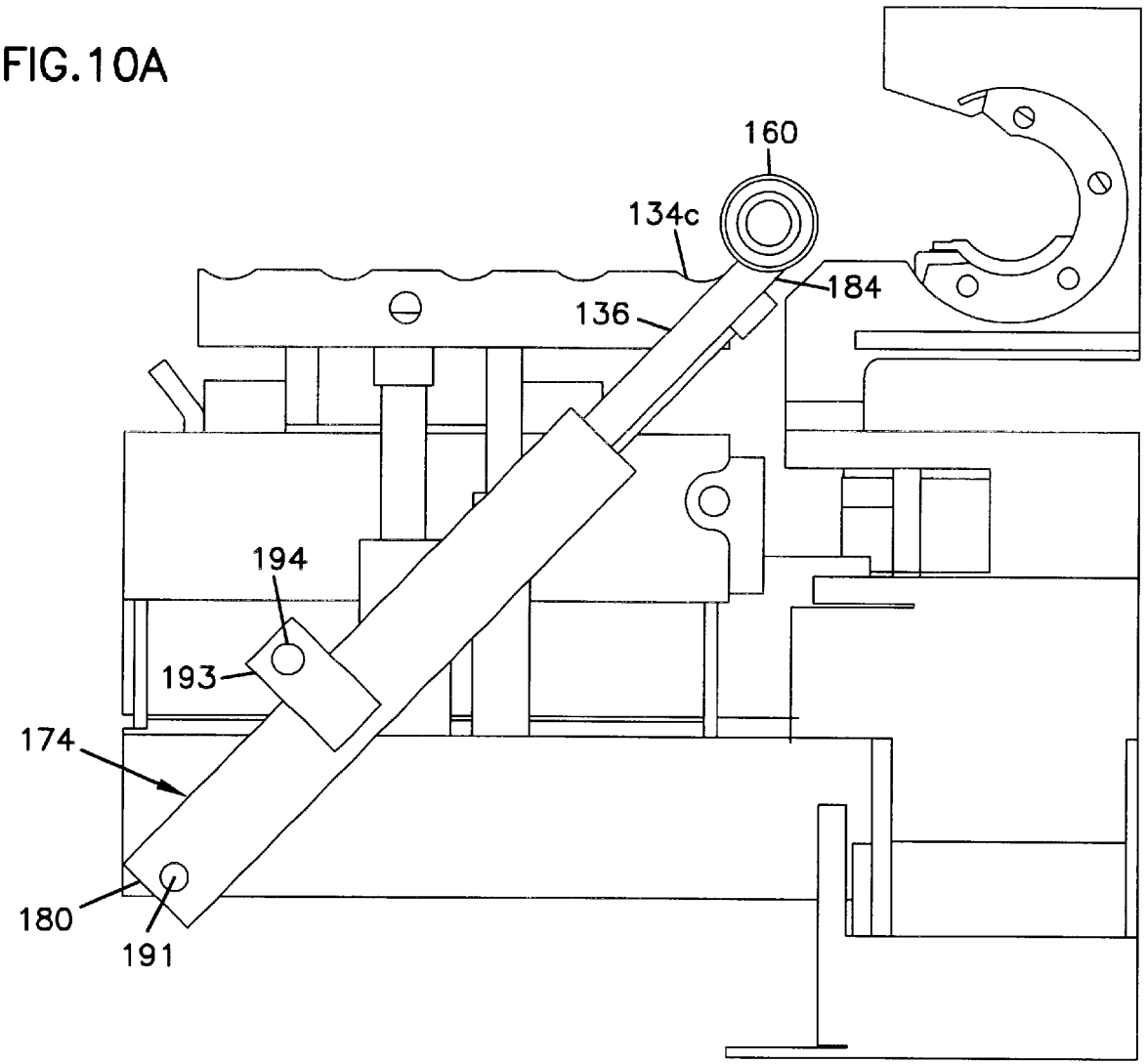
FIGS. 10*a*–10*d* illustrate how the rod transfer mechanism of FIGS. 8 and 9 moves a rod along a curved path as the rod is transferred between the magazine and the rotational drive head.
Figure 10B:
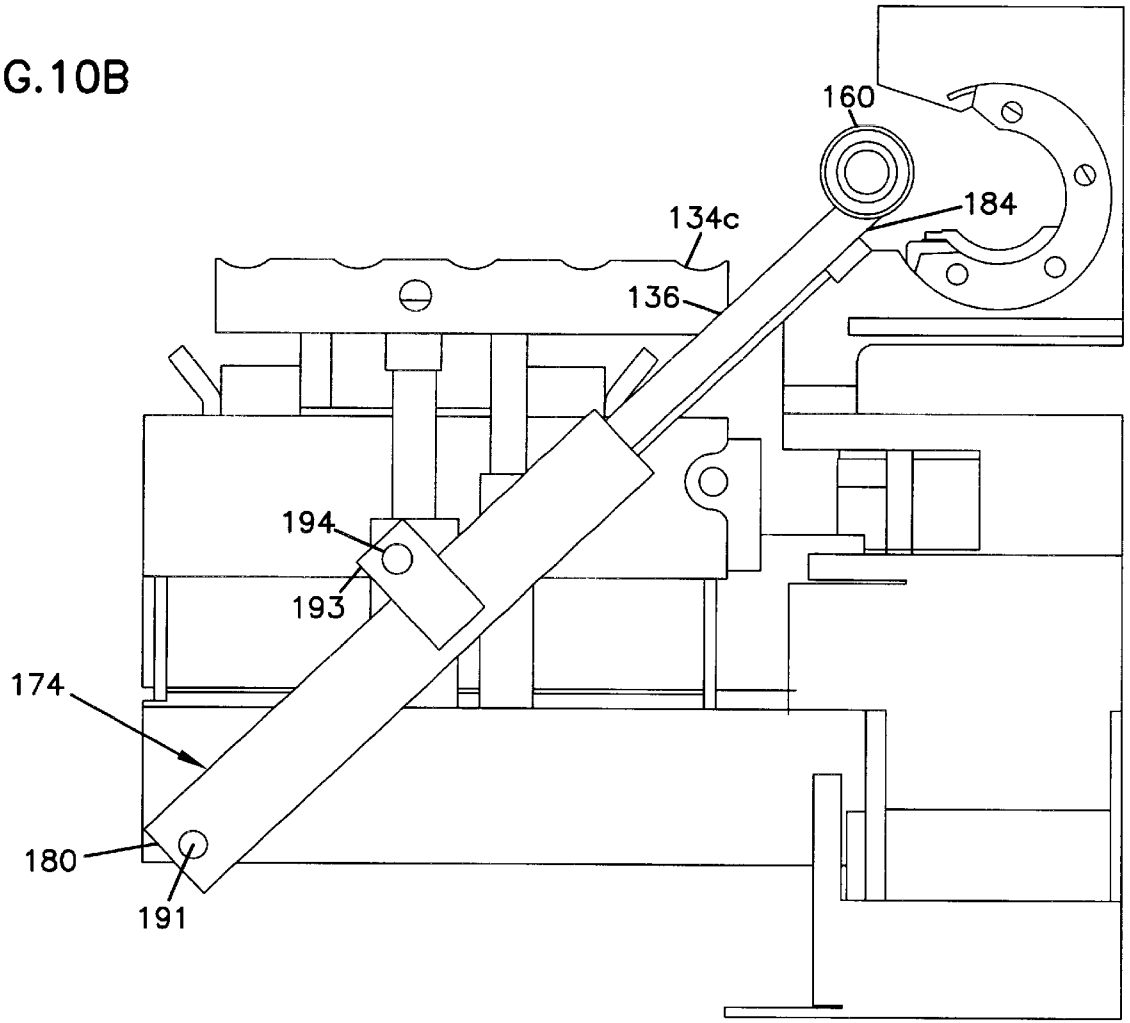
Figure 10C:
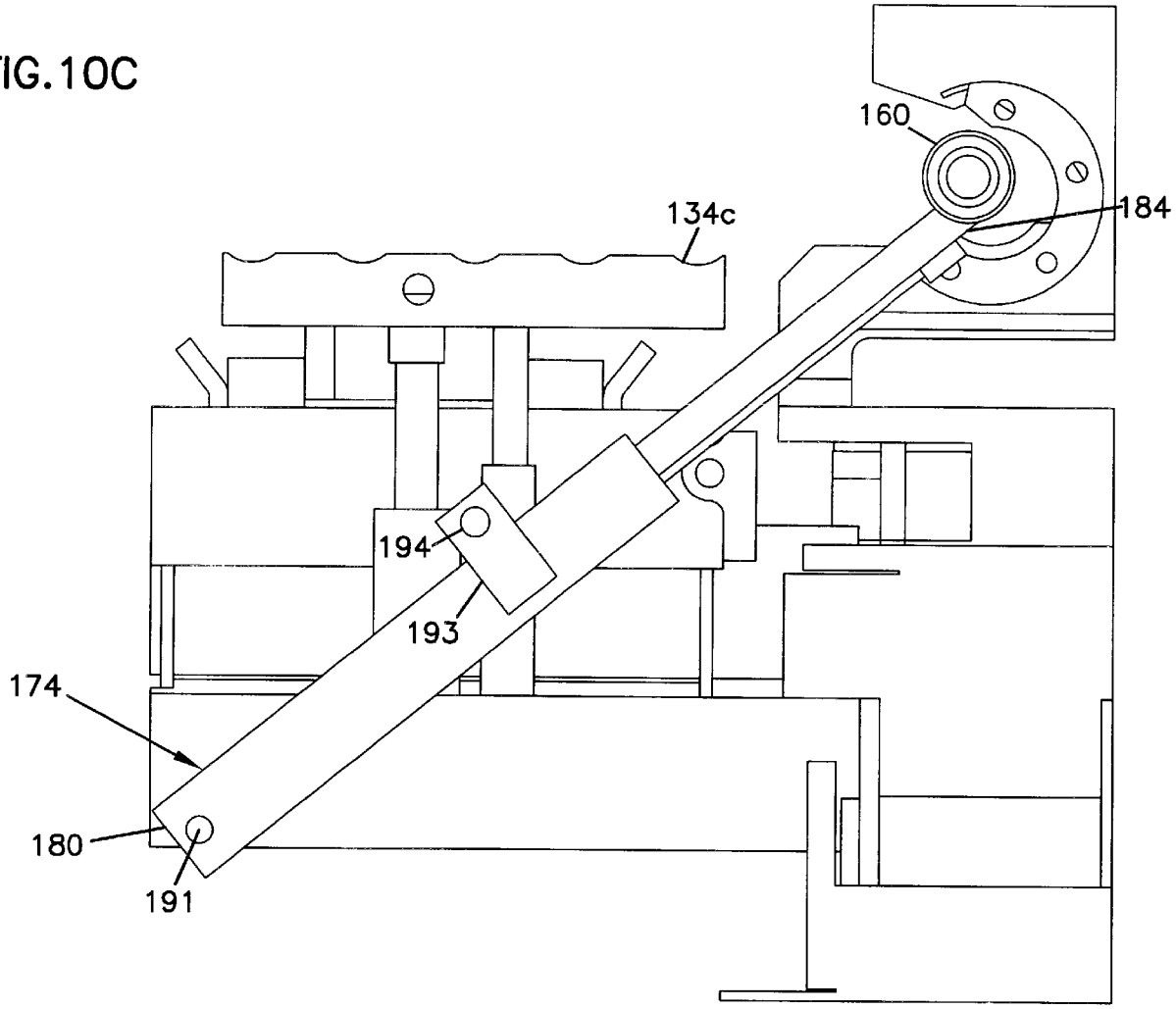
Figure 10D:
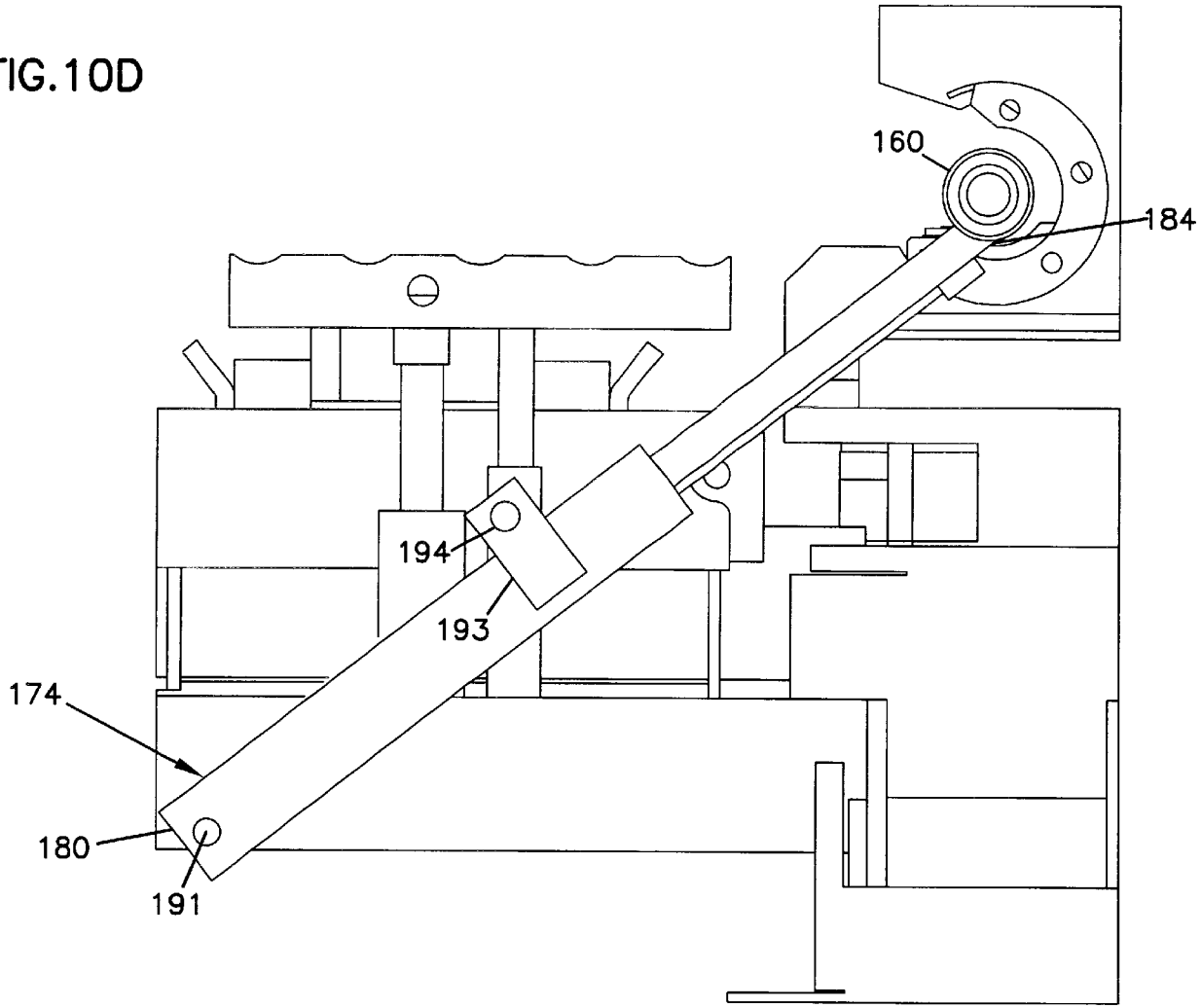

FIGS. 8 and 9 illustrate one of the transfer mechanisms 136 in isolation from the horizontal directional drilling machine 120. The depicted transfer mechanism 136 includes a frame including two spaced-apart, substantially parallel plates 168. The plates 168 are interconnected by spacers 170. The plates 160 define arcuate camming slots 172 that are aligned with one another. A drive cylinder 174 is mounted between the plates 168. The drive cylinder 174 includes a cylinder portion 176 and a piston rod portion 178. A base end 180 of the cylinder portion 176 is pivotally connected to the plates 168, and a free end 182 of the piston rod portion 178 is connected to a rod holder 184. As shown, the rod holder 184 comprises a magnet (e.g., an electromagnet or a permanent magnet) having a rod cradling recess 186. Alternatively, the rod holder can include any number of different configurations such as mechanical grippers, suction type holders, or full pockets. It will be appreciated that the drive cylinder 174 is preferably powered by hydraulic pressure.

The transfer mechanism 136 also includes a linkage 190 that extends along the drive cylinder 174. The linkage includes elongated members 192 positioned on opposite sides of the drive cylinder 174. The elongated members 192 are connected to the rod holder 184 and are parallel to the piston rod portion 178. Extensions 193 project transversely outward from the elongated members 192. The extensions 193 include rollers 194 that fit within the arcuate slots 172 of the plates 168.

To move the rod holder 184 from the rod box 128 to the drill string, the drive cylinder 174 is extended. By contrast, to return the rod holder 184 from the drill string to the rod box 128, the drive cylinder 174 is retracted. As the drive cylinder 174 is extended or retracted, the rollers 194 ride along the camming slots 172 thereby causing the base end 180 of the cylinder portion 176 to pivot such that the rod holder 184 moves along an arcuate path.

FIGS. 10*a*–10*d* illustrate a sequence in which the transfer mechanisms 136 move rod 160 from the rod cradling recesses 134*c* of the lifts 138 to the gripping units 150. As the drive cylinder 174 is extended, the base end 180 pivots about pivot point 191. Also, as the drive cylinder 174 is extended, rollers 194 ride in the arcuate slots 172 causing the rod holder 194 to move along an arcuate path. The arcuate path traversed by the rod holder 184 facilitates loading rods into side loading style gripping units. Concurrently, the transfer mechanisms 136 allow the bottom of the rod box 128 to be positioned below the gripping units 150 thereby lowering the center of gravity of the rod box 128.

VI. Indexing Assembly

Figure 11A:
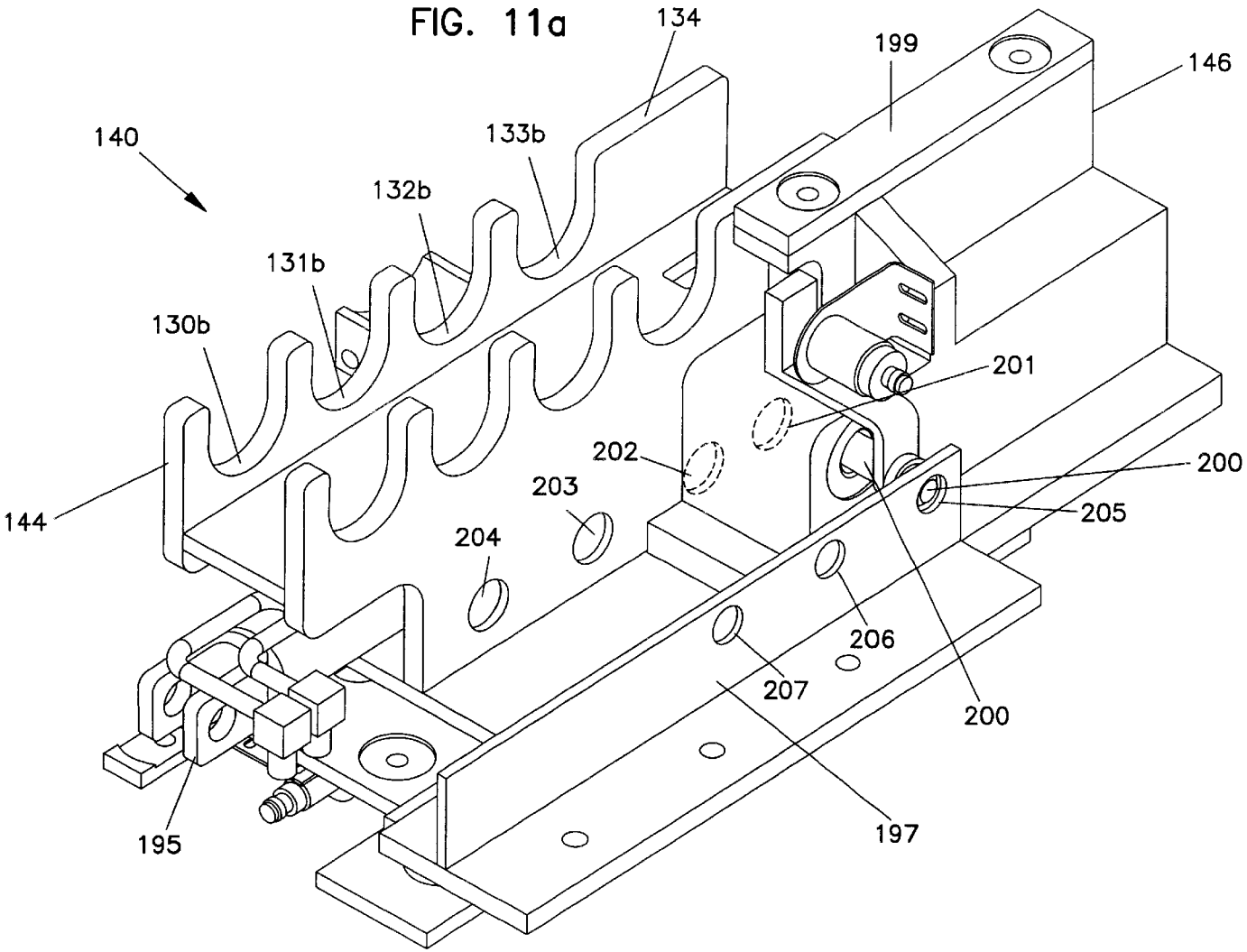
FIG. 11*a* illustrates one side of a rod indexing arrangement used by the horizontal directional drilling machine of FIG. 2.
Figure 11B:
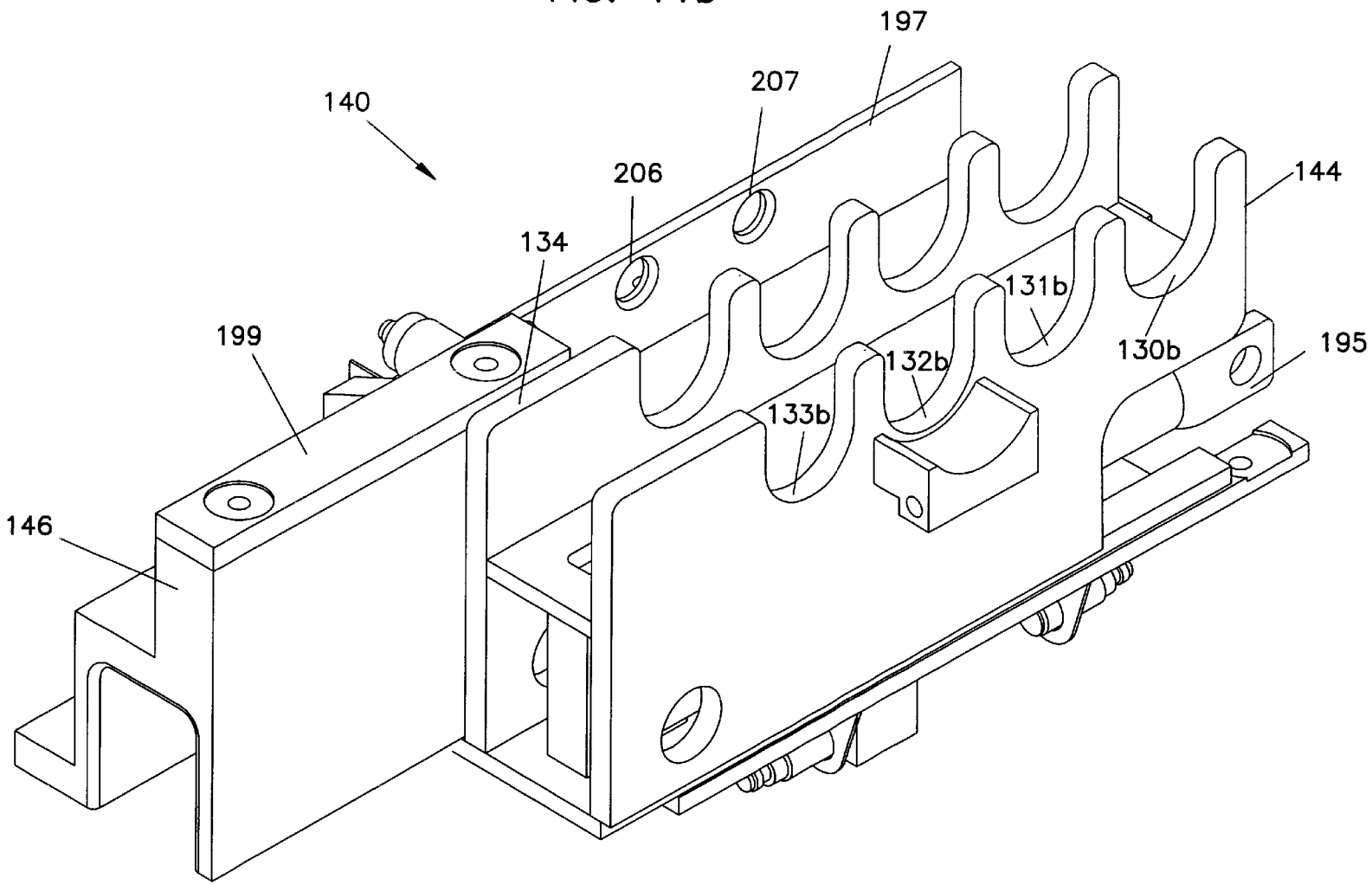
FIG. 11*b* illustrates the other side of the rod indexing arrangement of the FIG. 11*a;*

FIGS. 11*a* and 11*b* illustrate one of the indexing assemblies 140 in isolation from the horizontal directional drilling machine 120. The depicted indexing assembly 140 includes one of the feed structures 144 and one of the blocking structures 146. As shown in FIGS. 11*a* and 11*b*, a hydraulic cylinder 195 is provided for moving the feed structure 144 between the retracted position (shown in FIG. 5*a*) and the extended position (shown in FIG. 5*b*). However, it will be appreciated that other types of drives (e.g., rack and pinion drives, chain drives, etc.) could also be used.

For certain applications, it is desirable to block one or more of the pockets 131*b*–133*b* of the feed structure 144 so as to prevent rods from entering the pocket structures 131*b*–133*b*. This function is provided by the blocking structure 146. The blocking structure 146 is mounted between the feed structure 144 and a guide member 197. The guide member 197 is substantially parallel to the feed structure 144. The blocking structure 146 includes a top blocking surface 199 preferably positioned at the top of the feed structure 144. Preferably, the blocking surface 199 is sufficiently long or otherwise sized/shaped to be capable of concurrently blocking all but one of the pockets (e.g., pockets 131*b*–133*b*).

The blocking structure 146 also includes a pin 200 adapted to fit within openings 201–204 defined by the feed structure 144. The pin is preferably mechanically actuated (e.g., by a solenoid or drive cylinder). When the pin 200 is inserted within opening 201, the blocking structure 46 is oriented in a non-blocking position (shown in FIGS. 11*a* and 11*b*) in which the blocking surface 199 is positioned generally adjacent to the blocking element 134 of the feed structure 144. In the non-blocking position, the blocking surface 199 does not block any of the pockets 131*b*–133*b*. Because the pin 200 is inserted within the opening 201, the blocking structure 146 moves in concert with the feed structure 144 as the feed structure 144 is retracted and extended.

The blocking structure 146 is particularly useful for loading rods into the rod box 128. For example, when rods are loaded into the rod box 128 with none of the pockets 131*b*–133*b* blocked, the rods will continuously be fed into the last column 133*a* of the rod box 128. When the column 133*a* becomes full of rods, it is desirable to block the pocket 133*b* to prevent further rods from being fed into the last column 133*a*. This is accomplished by disengaging the pin 200 from the opening 201, generating relative movement between the blocking structure 146 and the feed structure 144 until the pin 200 aligns with the opening 202, and the inserting the pin 200 within the opening 202. With the pin 200 inserted within the opening 202, the blocking structure 146 is oriented in a first blocking position in which the blocking surface 199 blocks the pocket 133*b*. With the pocket 133*b* blocked, rods fed into the rod box 128 are loaded into the column 132*a*. Because the pin 200 is inserted within the opening 202, the blocking structure 146 once again moves in concert with the feed structure 144 as the column 132*a* is loaded.

After the column 132*a* has been filled with rods, it is desirable to block the pocket 142*b* to prevent additional rods from being loaded into the column 132*a*. Thus, the blocking structure 146 is moved to a second blocking position by: 1) removing the pin 200 from the opening 202; 2) generating relative movement between the blocking structure 146 and the feed structure 144 until the pin 200 aligns with the opening 203; and 3) inserting the pin 200 into the opening 203. With the pin 200 inserted into the opening 203, the blocking structure 146 moves in concert with the feed structure 144 and functions to block both of the pockets 132*b* and 133*b*.

With the blocking structure 146 in the second blocking position, rods fed into the rod box 128 are loaded into the column 131*a*. Once the column 131*a* is filled, the blocking structure 146 is moved to a third blocking position by: 1) removing the pin 200 from the opening 203; 2) generating relative movement between the blocking structure 146 and the feed structure 144 until the pin 200 is brought into alignment with the opening 204; and 3) inserting the pin 201 into the opening 204. With the pin 200 inserted into the opening 204, the blocking structure 146 moves in concert with the feed structure 144 and functions to concurrently block each of the pockets 131*b*–133*b*. Thus, rods fed into the rod box 128 are loaded into the first column 130*a*.

Figure 12B:
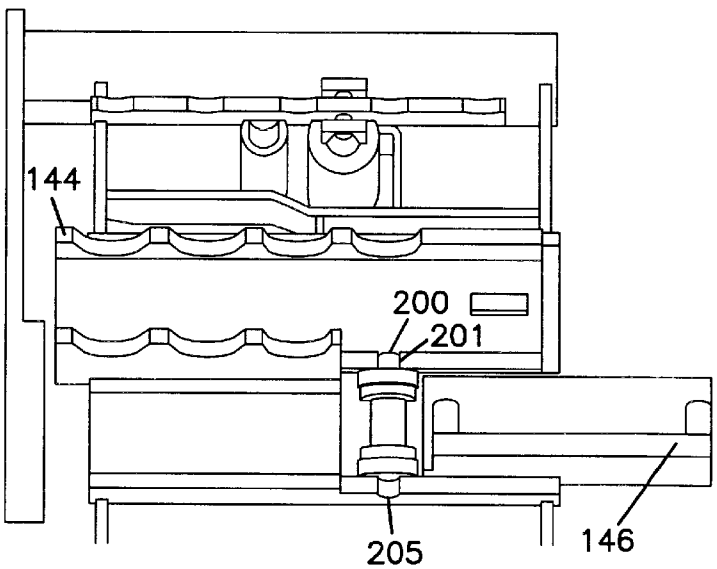
FIGS. 12*a*–12*f* illustrate a blocker sequence for the rod indexing arrangement of FIGS. 11*a* and 11*b,* portions of the rod indexing assembly have been broken away for clarity.
Figure 12A:
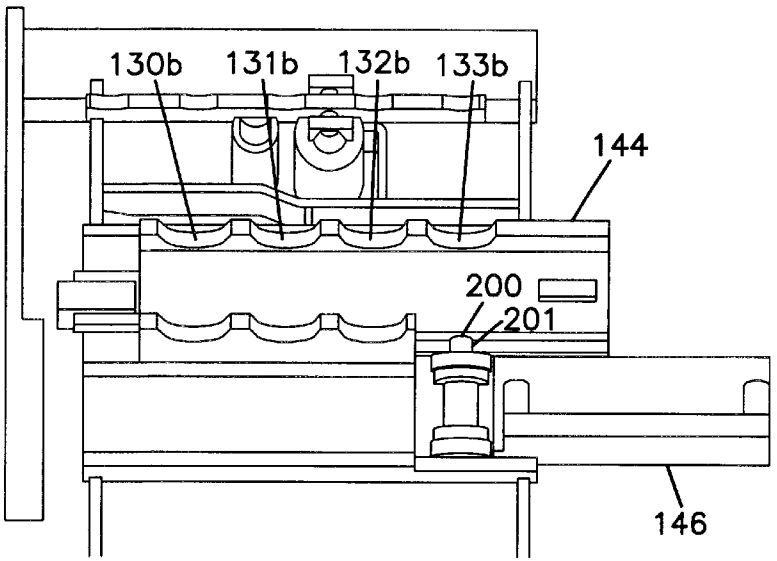
Figure 12D:
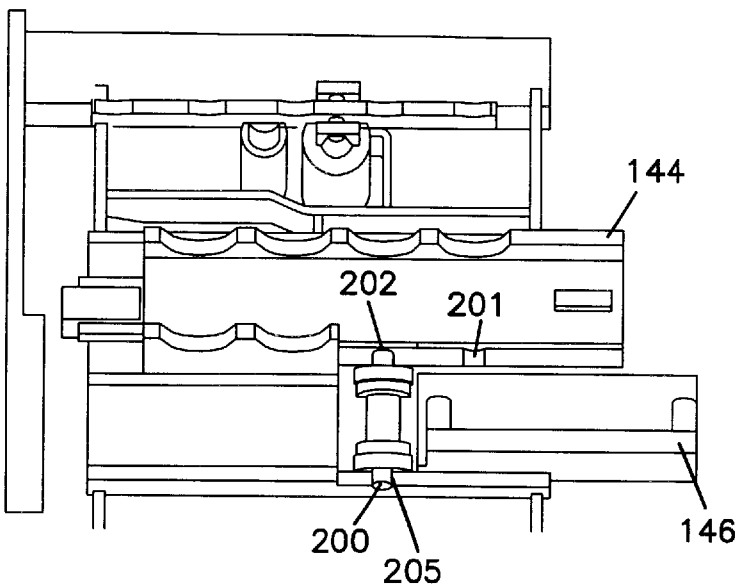
Figure 12C:
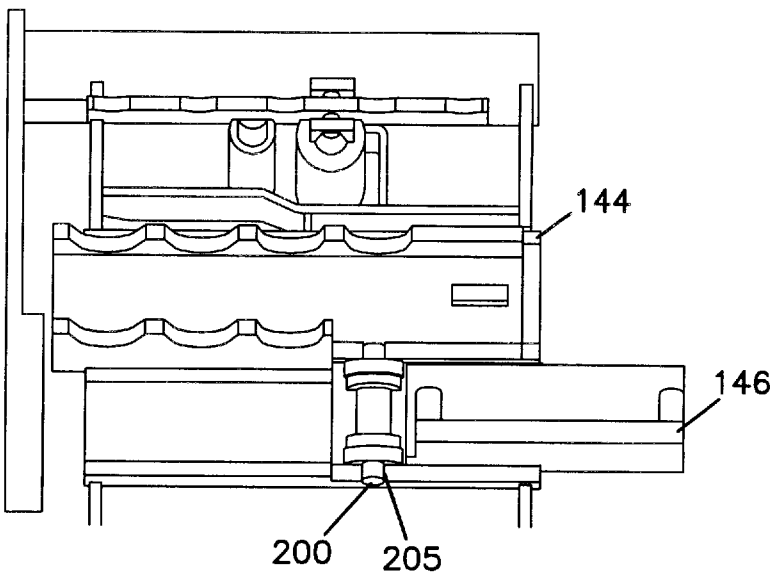
Figure 12F:
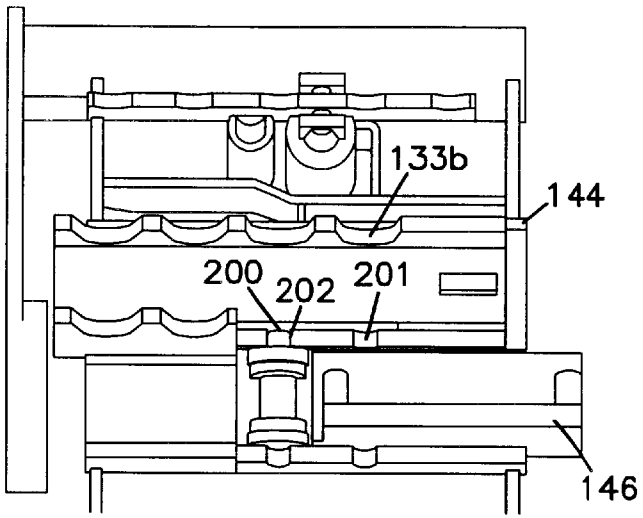
Figure 12E:
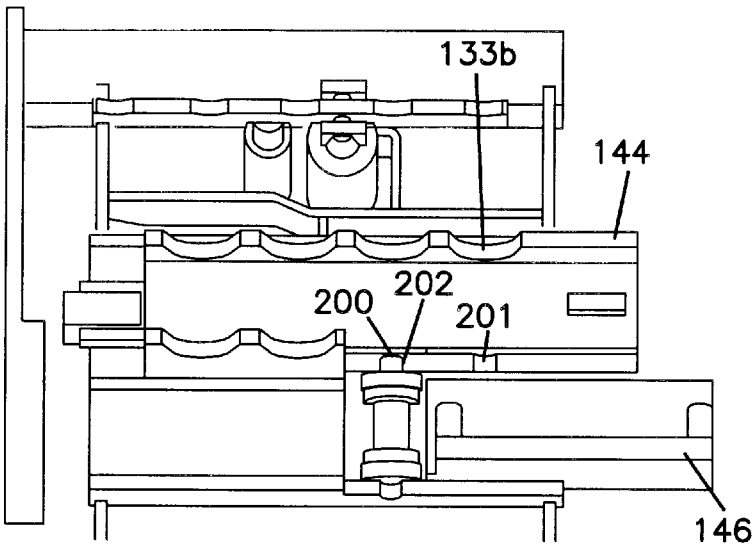

FIGS. 12*a*–12*f* illustrate a sequence for moving the blocking structure 146 from the non-blocking position to the first blocking position in which the blocking structure 146 blocks the pocket 133*b*. As shown in FIG. 12*a*, the blocking structure 146 is positioned in the non-blocking position with the pin 200 inserted in the opening 201 of the feed structure 144. The feed structure 144 is shown in a retracted position. To initiate the sequence, the feed structure 144 is first extended as shown in FIG. 12*b*. With the feed structure 144 extended, the pin 200 is disengaged from the opening 201 and inserted into an opening 205 defined by the guide member 197 (see FIG. 12*c*). Movement of the pin 200 is preferably done automatically/mechanically (e.g., by a solenoid), but could also be done manually. The feed structure 144 is then retracted, while the blocking structure 146 remains stationary, to generate relative movement between the feed structure 144 and the blocking structure 146. After retraction, the blocking structure 146 is located at the position in which pocket structure 133*b* is blocked (see FIG. 12*d*). To retain the blocking structure 146 in this position, the pin 200 is removed from the opening 205 in the guide member 197, and inserted into the opening 202 defined by the feed structure 144 (see FIG. 12*e*). Thereafter, the blocking structure 146 will move in concert with the feed structure 144 as the feed structure 144 is retracted and extended to load additional rods into the magazine (see FIG. 12*f*).

As described above, FIGS. 12*a*–12*f* illustrate a sequence for moving the blocking structure 146 from the non-blocking position to the first blocking position in which the pocket 133*b* is blocked. It will be appreciated that similar sequences can be used to move the blocking structure 146 to the second blocking position corresponding to the opening 203 (i.e., position in which both of the pockets 132*b* and 133*b* are blocked), and the third blocking position corresponding to the opening 204 (i.e., the blocking position in which all three of the pockets 131*b*–133*b* are blocked). For example, to move the blocking structure 146 from the first blocking position to the second blocking position, the feed structure 144 is extended, and the pin 200 is inserted into opening 206 defined by the guide member 197. The feed structure 144 is then retracted while the blocking structure 146 remains stationary. The feed structure 144 is preferably retracted until the opening 203 is brought into alignment with the pin 200. Once alignment is achieved, the pin 200 is removed from the opening 206 of the guide member 197, and inserted into the opening 203 of the feed structure 144 such that the blocking structure 146 is locked in the second blocking position.

To move the blocking structure 146 from the second blocking position to the third blocking position, the feed structure 144 is again extended. Once extended, the pin 200 is inserted into opening 207 defined by the guide member 197 to prevent the blocking structure 146 from moving with the feed structure 144. The feed structure 144 is then retracted until the pin 200 is brought into alignment with the opening 204 of the feed structure 144. Finally, pin 200 is removed from the opening 207 in the guide member 197, and inserted into the opening 204 of the feed structure 144 to lock the blocking structure 146 in the third blocking position.

In addition to performing blocking functions when rods are being loaded into the rod box 128, the blocking structures 146 can also be used to control which column of the rod box 128 from which rods are unloaded. For example, during a typical unloading operation, rods are first unloaded from column 133*a,* next unloaded from column 132*a,* subsequently unloaded from column 131*a* and finally unloaded from 130*a*. However, this can be varied by using the blocking structures 146. For example, with the rod box 128 full, the blocking structures 146 can be placed in the third blocking location thereby causing rods to initially be unloaded from the column 130*a*. After column 130*a* has been emptied, the blocking structures 146 can be moved to the second blocking position thereby allowing rods to be unloaded from column 131*a*. Once column 131*a* has been unloaded, the blocking structures 146 can be moved to the first blocking position thereby allowing rods to be unloaded from column 132*a*. After column 132*a* has been unloaded, the blocking structures 146 can be moved to the non-blocking position such that rods can be unloaded from column 133*a*.

VII. Blocker Control System

Figure 13:
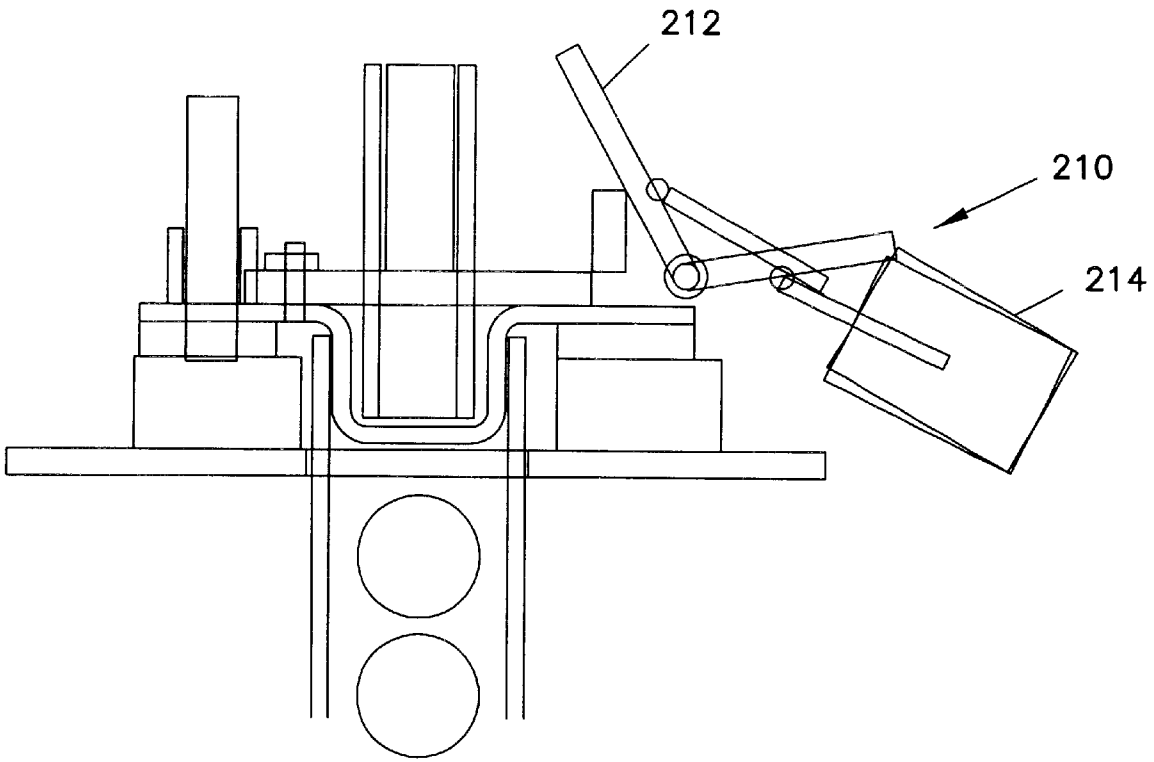
FIG. 13 illustrates an alternative blocking arrangement.

FIG. 13 illustrates a blocking unit 210 including a pivot blocker 212 that is moved between a blocking position and a non-blocking position by an actuator 214 (e.g., a drive cylinder, a drive motor or other type of drive mechanism). Preferably, separate blocking units 210 are provided for each of the pockets 131*b*–133*b*. For such an embodiment, each of the blocking units 210 moves in concert with the feed structure 144, and each of the blocking units 210 can be independently actuated.

While the blocker 212 is shown as a pivot member, it will be appreciated that the movement need not be pivotal. Instead, any type of movement for moving the blocking member between a blocking position and a non-blocking position can be utilized. For example, in certain embodiments, blocking member can be slid up and down relative to the feed structure 144.

Figure 14A:
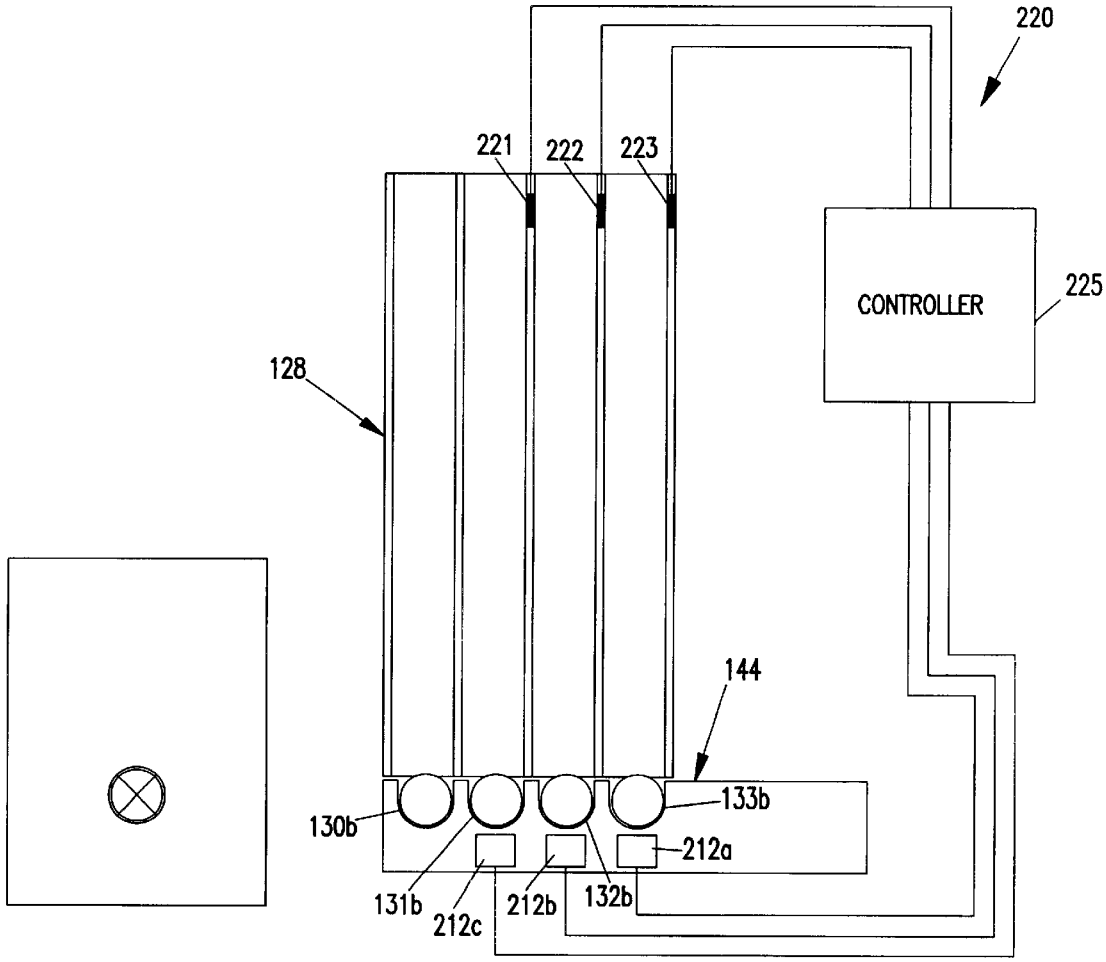
FIG. 14*a* is a schematic depiction of a further pocket blocking system.

FIG. 14*a* illustrates an inventive blocker control system 220. The blocker control system 220 is shown in combination with the previously described rod box 128 and feed structure 144. The control system includes blockers 212*a*–212*c* mounted to move in unison with the feed structure 144. The blockers 212*a*–212*c* respectively correspond to pockets 133*b*–131*b* of the feed structure 144. Sensors 221–223 (e.g., proximity sensors) are provided at the top of the rod box 128. The sensors 221–223 interface with a controller 225. It will be appreciated that the controller 225 can be any type of known controller such as a computer, microprocessor, software driven controller, firmware driven controller or mechanical controller. The controller 225 also interfaces with the blockers 212*a*–212*c*.

Figure 14C:
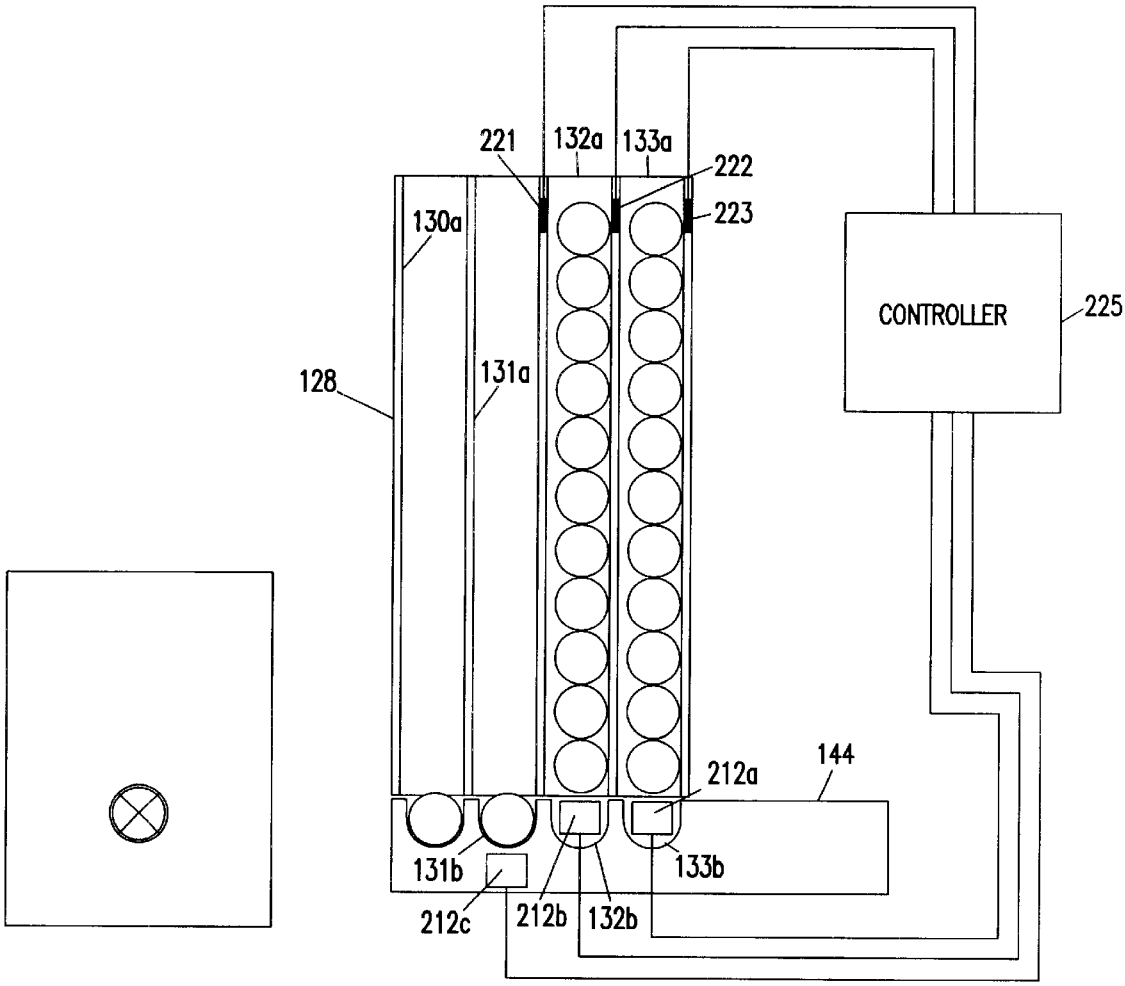
Figure 14D:
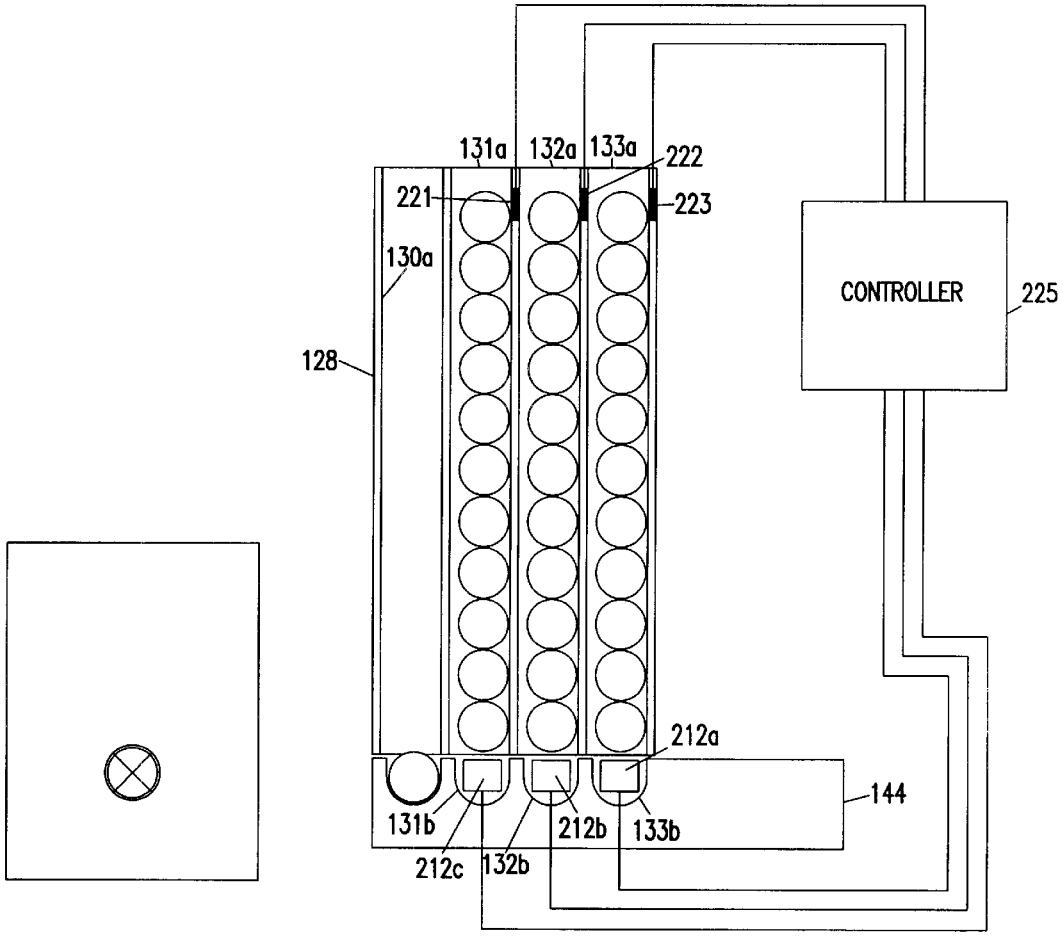

FIGS. 14*b*–14*d* illustrate a sequence for loading the rod box 128. As shown in FIG. 14*b,* rods are initially loaded into the column 133*a* of the rod box 126. When the column 133*a* is full of pipes, the sensor 223 detects that the column 133*a* is full and signals the controller 225. The controller 225 then causes the blocker 212*a* to be actuated such that the blocker 212*a* prevents further rods from being loaded into the pocket 133*b*. Subsequently, rods are loaded into the column 132*a* . When the column 132*a* is fully loaded, the sensor 232 detects the uppermost rod and signals the controller 225 that the column 132*a* is full. The controller 225 then signals an actuator to move the blocker 212*b* to a blocking position (see FIG. 14*c*) such that additional rods are prevented from entering the pocket 132*b* . Thereafter, rods are loaded into the column 131*a* of the rod box 128. When the column 131*a* is full, the sensor 221 signals the controller 225. The controller 225 then signals an actuator to cause the blocker 212*c* to block the pocket structure 131*b* as shown in FIG. 14*d*. With the pocket structures 131*b*–133*b* blocked, rods are loaded into the column 130*a* of the rod box 128.

While control system 225 has been shown in association with blockers 212*a*–212*c* that can be independently actuated, a similar control system can be used for automatically controlling the position of the blocking structures 146 of the horizontal directional drilling machine 120 of FIGS. 2–4. For example, upon detection that the column 133*a* is full, a controller (e.g., a software driven controller) can automatically sequence the indexing assemblies 140 through the steps shown in FIGS. 12*a*–12*f* to move the blocking structures 146 from the non-blocking positions to the first blocking positions. Similarly, when the column 132*a* is full, the controller can automatically sequence the indexing assemblies 140 through the steps used to move the blocking structures 146 to the second blocking positions. Further, when the column 131*a* is full, the controller can cause the indexing assemblies 140 to move through the sequence of steps used to move the blocking structures 146 to the third blocking positions.

It will be appreciated that the blocking structures 146 can be moved from the third blocking position back to the non-blocking position by reversing the sequence of steps described above.

VIII. Other Drilling Machine

Figure 15:
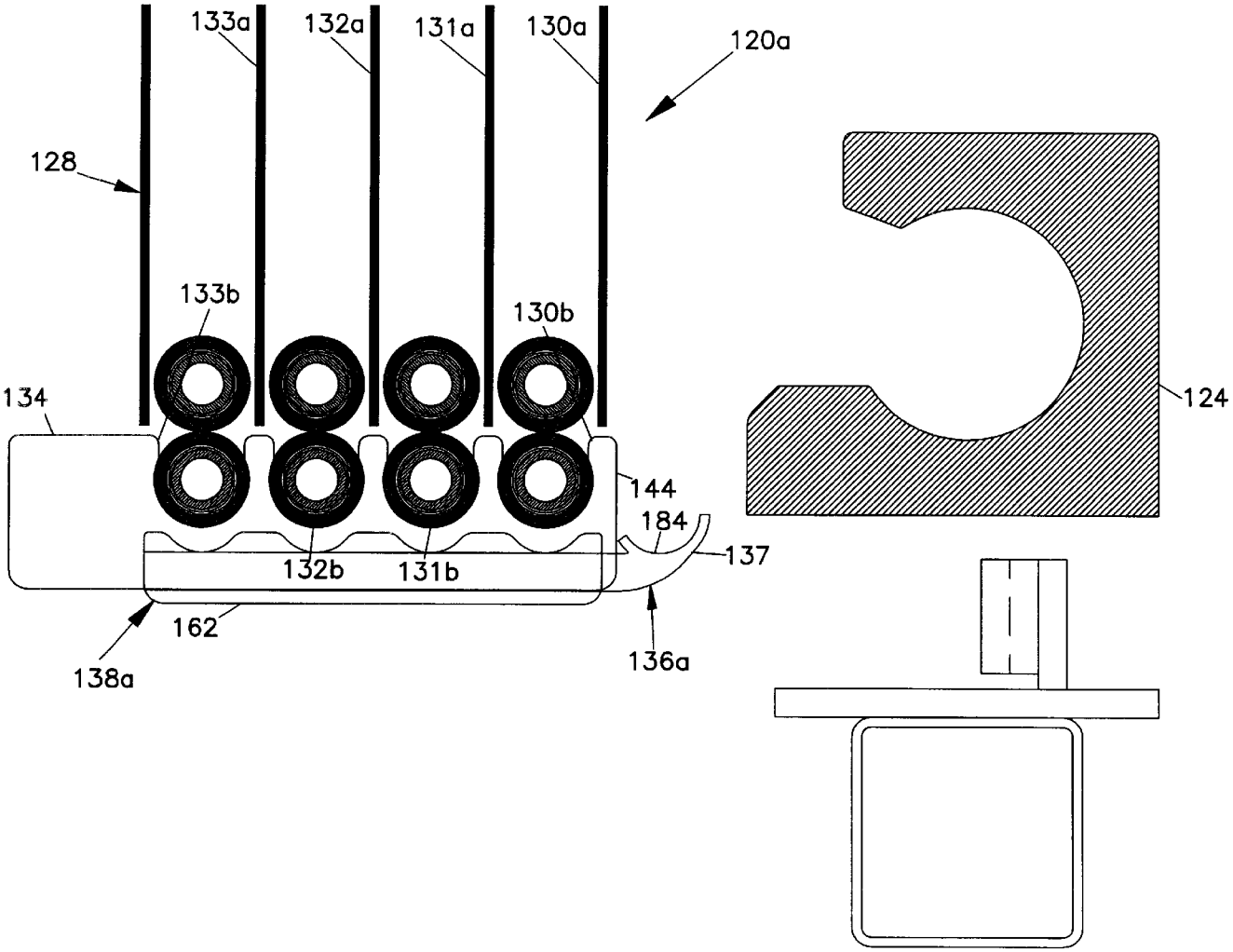
FIG. 15 illustrates another horizontal directional drilling machine.

FIG. 15 illustrates another horizontal directional drilling machine 120*a* incorporating the same rod box 128, feed member 144 and rotational driver 124 previously described with respect to the horizontal directional drilling machine of FIGS. 2–4. The horizontal directional drilling machine 120*a* includes a modified transfer mechanism 136*a* including a transfer member 137 having a rod holder 184. The transfer mechanism 136*a* includes a drive (e.g., a hydraulic cylinder) for extending and retracting the transfer member 137. The transfer mechanism 136*a* is preferably connected to a lift 138*a* in such a manner that the transfer member 137 is raised and lowered in concert with the lift 138*a*. In one embodiment, the transfer mechanism 136*a* includes a hydraulic cylinder including a cylinder portion connected to the lift 138*a* (e.g., by welding, fasteners, brackets, linkages, etc.) and a piston rod portion that forms the transfer member 137. Similar to previous embodiments, it will be appreciated that a pair of feed members 144, transfer mechanisms 136*a* and lifts 138*a* are preferably provided beneath the rod box 128. However, for ease of explanation, each of the components will be described as being singular.

Figure 16A:
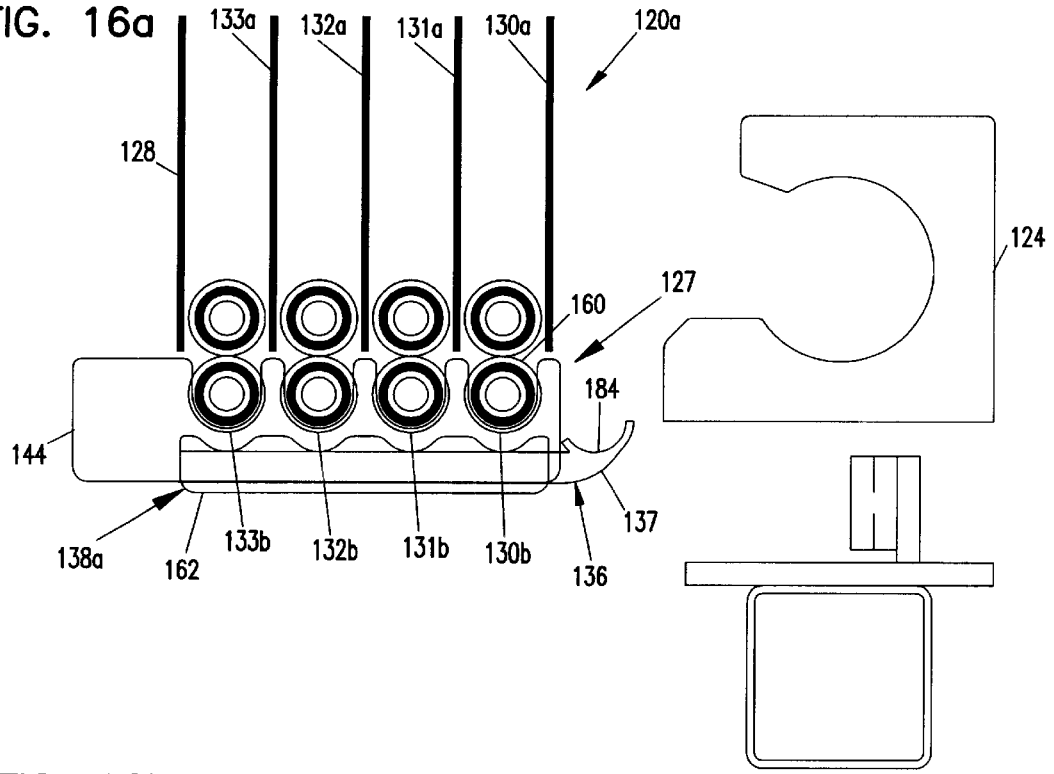
FIGS. 16*a*–16*g* illustrate a rod transfer sequence for moving a rod from the magazine to the rotational driver of the directional drilling machine of FIG. 15.

FIGS. 16*a*–16*g* illustrate a transfer sequence for moving rod 160 from the rod box 128 to the rotational driver 124 during a drilling operation. In FIG. 16*a,* rod 160 is located within pocket 130*b* of the feed member 144, and the feed member 144 is oriented in a retracted position in which pockets 130*b*–133*b* are positioned directly beneath respective columns 130*a*–133*a*. Also, the lift 138*a* is lowered such that the lowermost row of rods in the rod box 128 is supported within the pockets 130*b*–133*b* of the feed members 144. Further, the rod transfer member 137 is retracted such that the rod holder 184 is located directly beneath a rod staging location 127.

Figure 16B:
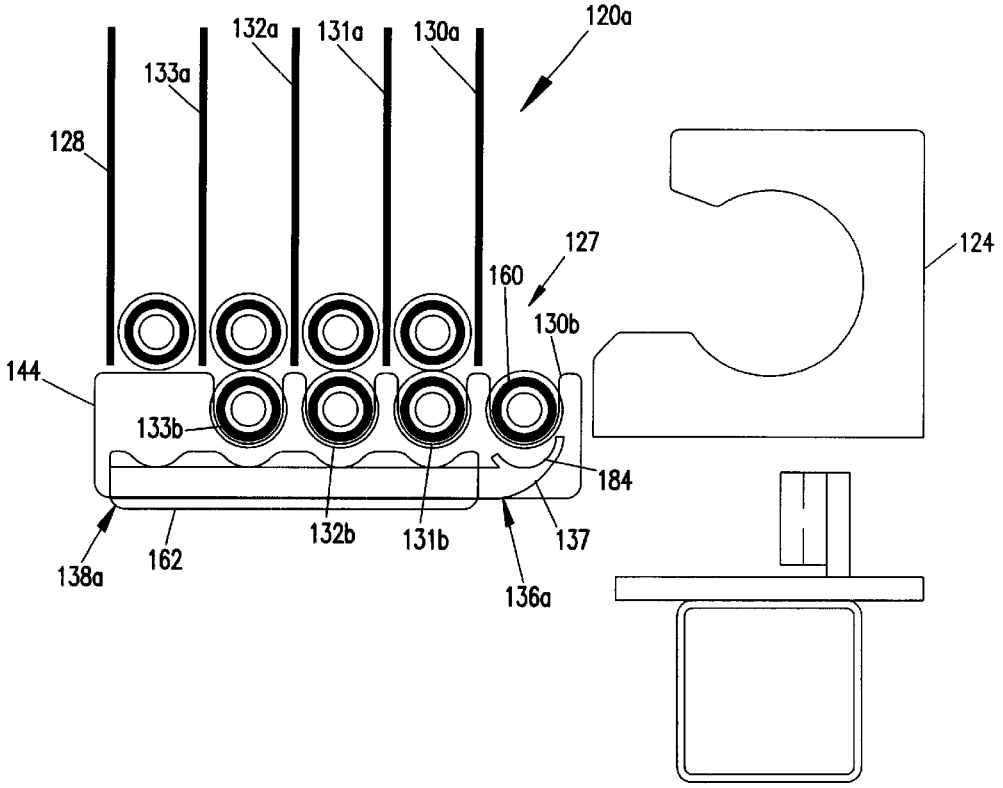
Figure 16C:
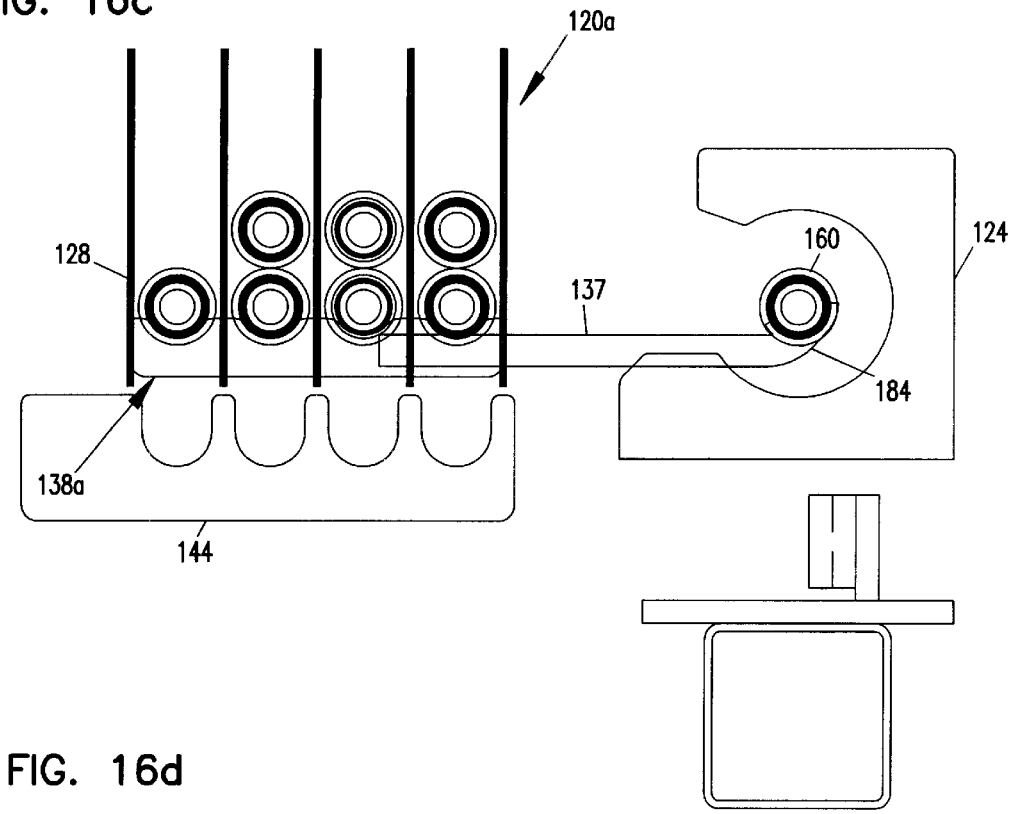

To initiate the transfer sequence, the feed member 144 is moved from the retracted position of FIG. 16*a* to an extended position as shown in FIG. 16*b*. In the extended position, the pocket 130*b* is positioned at the staging location 127. The staging location 127 is preferably offset at least one rod width from beneath the rod box 128. With the pocket 130*b* positioned at the staging location 127, the lift 138*a* is raised as shown in FIG. 16*c*. By raising the lift 138*a*, the lowermost row of rods is lifted above the feed member 144 and into the rod box 128 (i.e., the rods of are lifted from the pockets 131*b*–133*b* ). As the lift 138*a* is raised, the transfer member 137 is concurrently raised causing the rod holder 184 to lift the rod 160 from the pocket 130*b*.

Figure 16D:
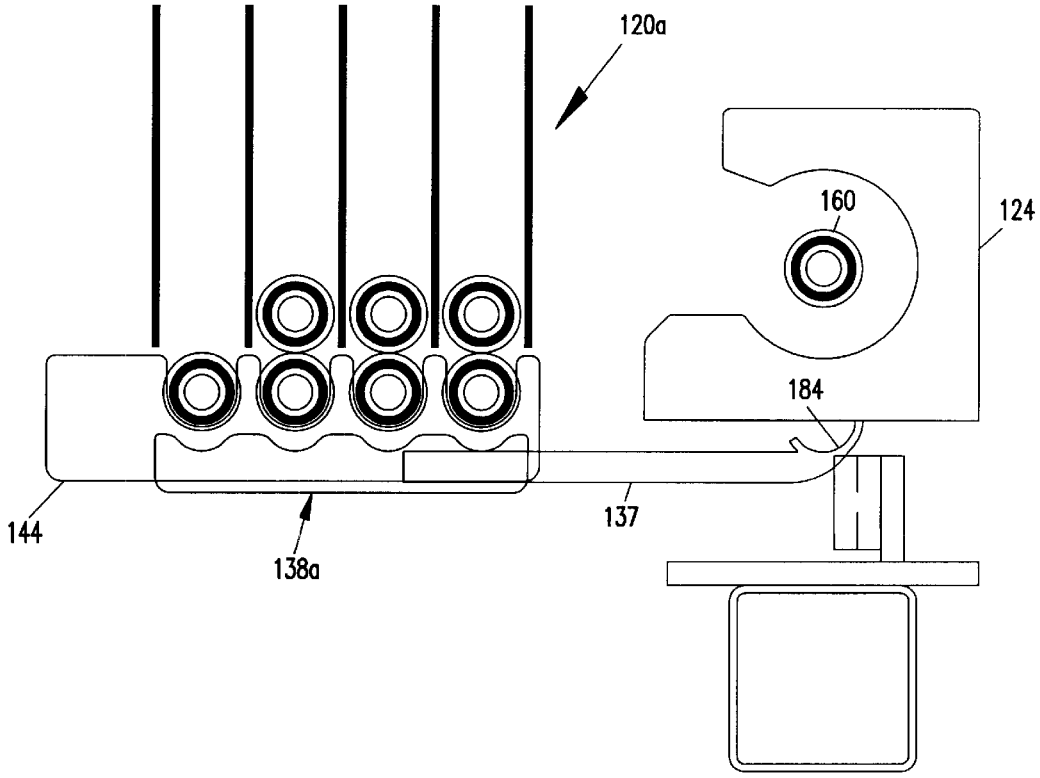
Figure 16E:
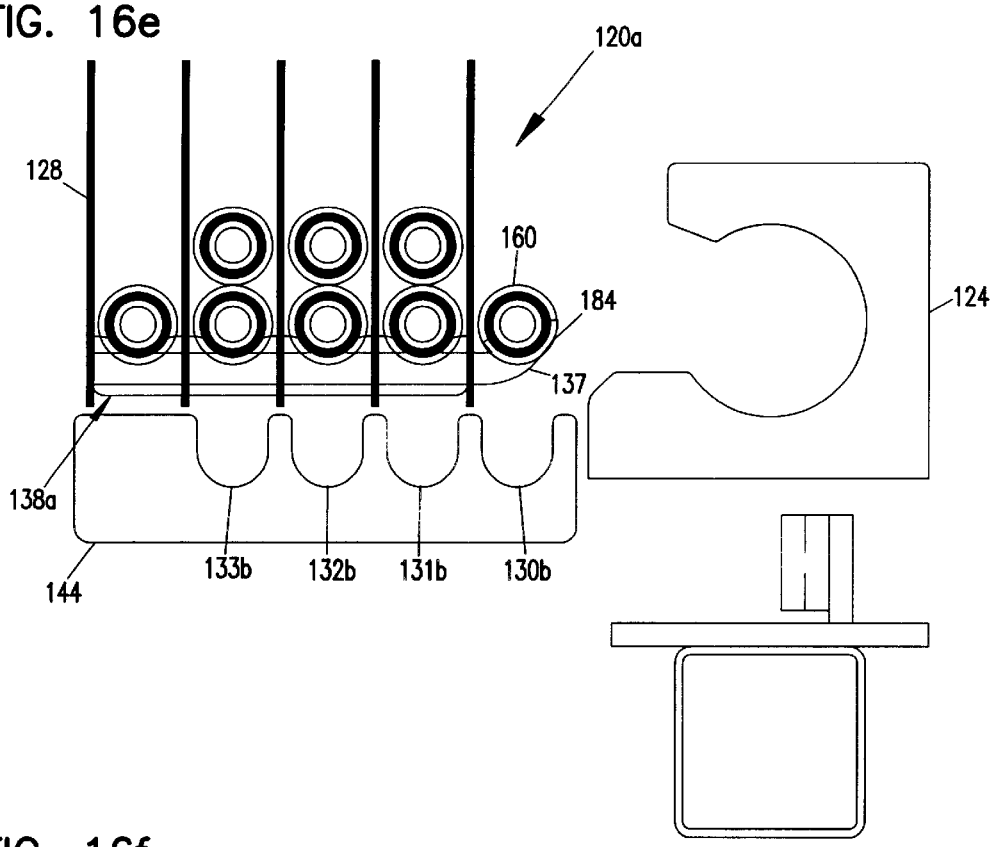
Figure 16F:
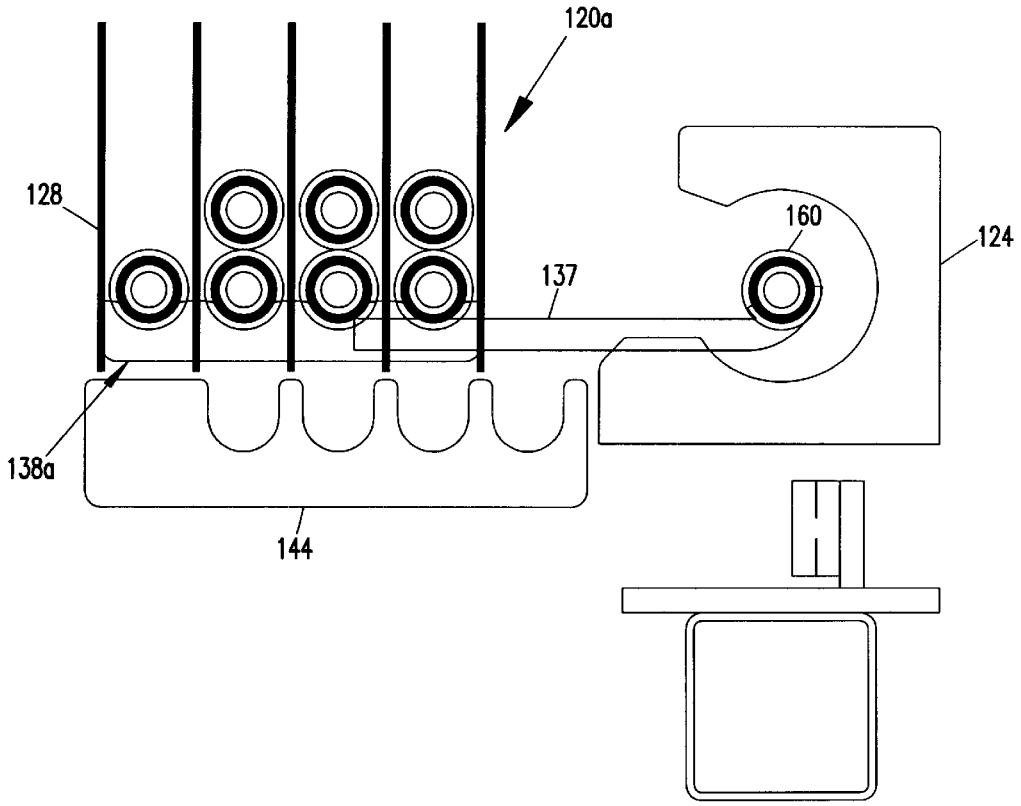
Figure 16G:
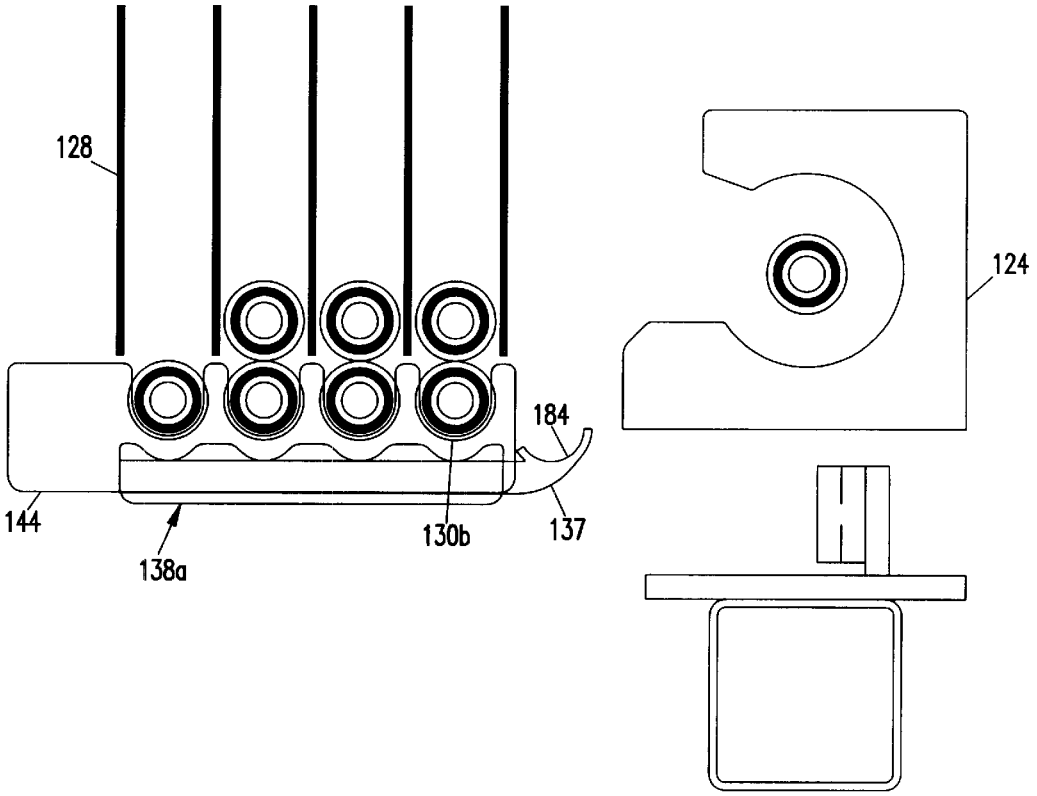

With the lift 138*a* raised and the rod 160 held by the rod holder 184, the rod transfer member 137 is moved from the retracted position of FIG. 16*c* to the extended position of FIG. 16*d*. With the transfer member 137 extended, the rod holder 184 holds the rod 160 in alignment with the rotational driver 124 thereby allowing the rod 160 to be coupled to the rotational driver 124. After the rod 160 has been coupled to the rotational driver 124, the feed member 144 is retracted beneath the rod box 128 as shown in FIG. 16*e*, and the lift 138*a* is lowered as shown in FIG. 16*f*. By lowering the lift 138*a*, the transfer member 137 is lowered to displace the rods holder 184 from the rod 160. Finally, the transfer member 137 is returned to the retracted position as shown in FIG. 16*g*, and the cycle can be repeated to transfer the next rod (i.e., the rod held within pocket 130*b*) to the rotational driver 124. It will be appreciated that the sequence can be reversed to move rods from the rotational driver 124 back to the rod box 128.

Figure 17A:
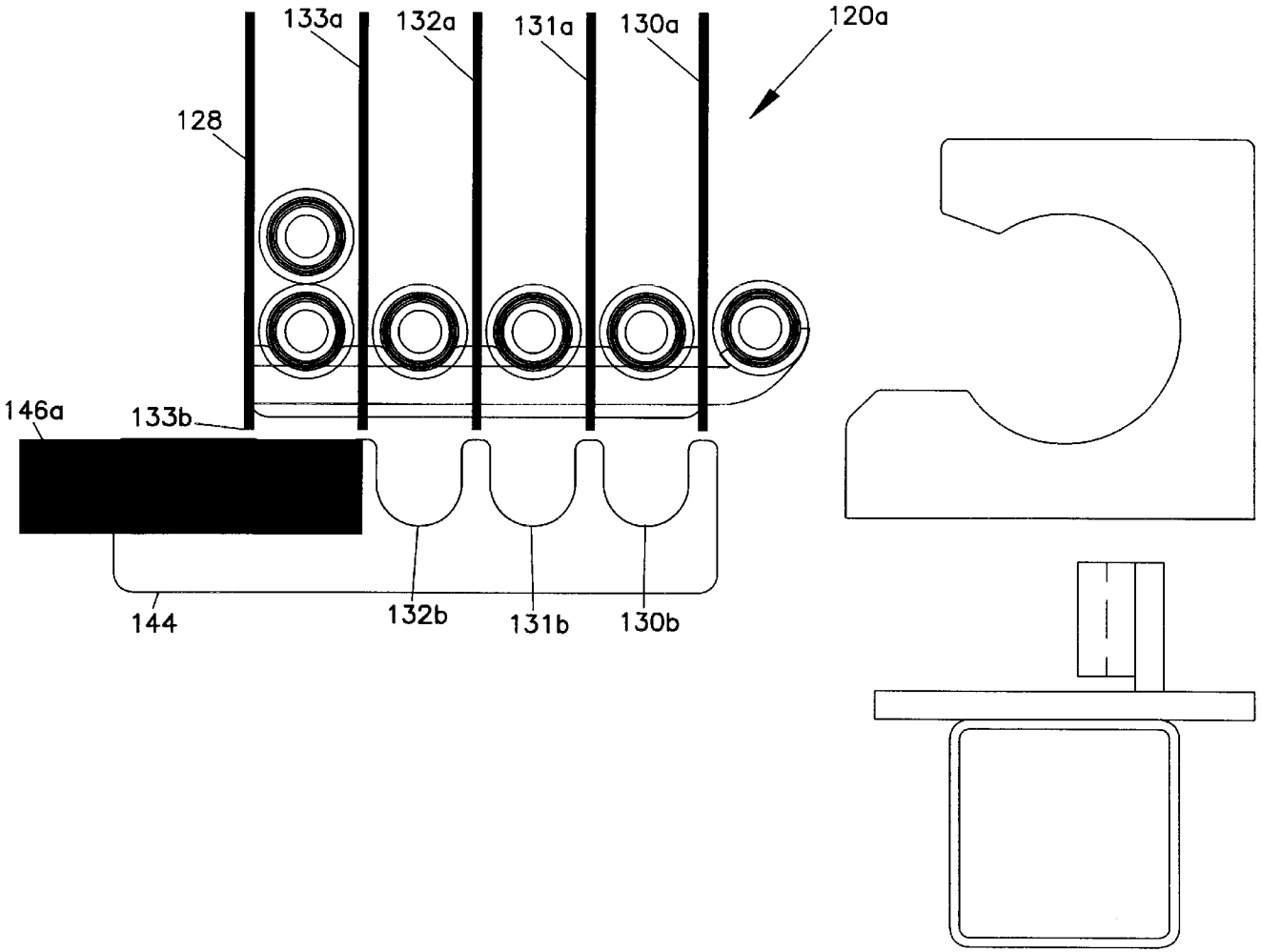
FIGS. 17*a*–17*c* illustrate various blocker positions for the directional drilling machine of FIG. 15.
Figure 17B:
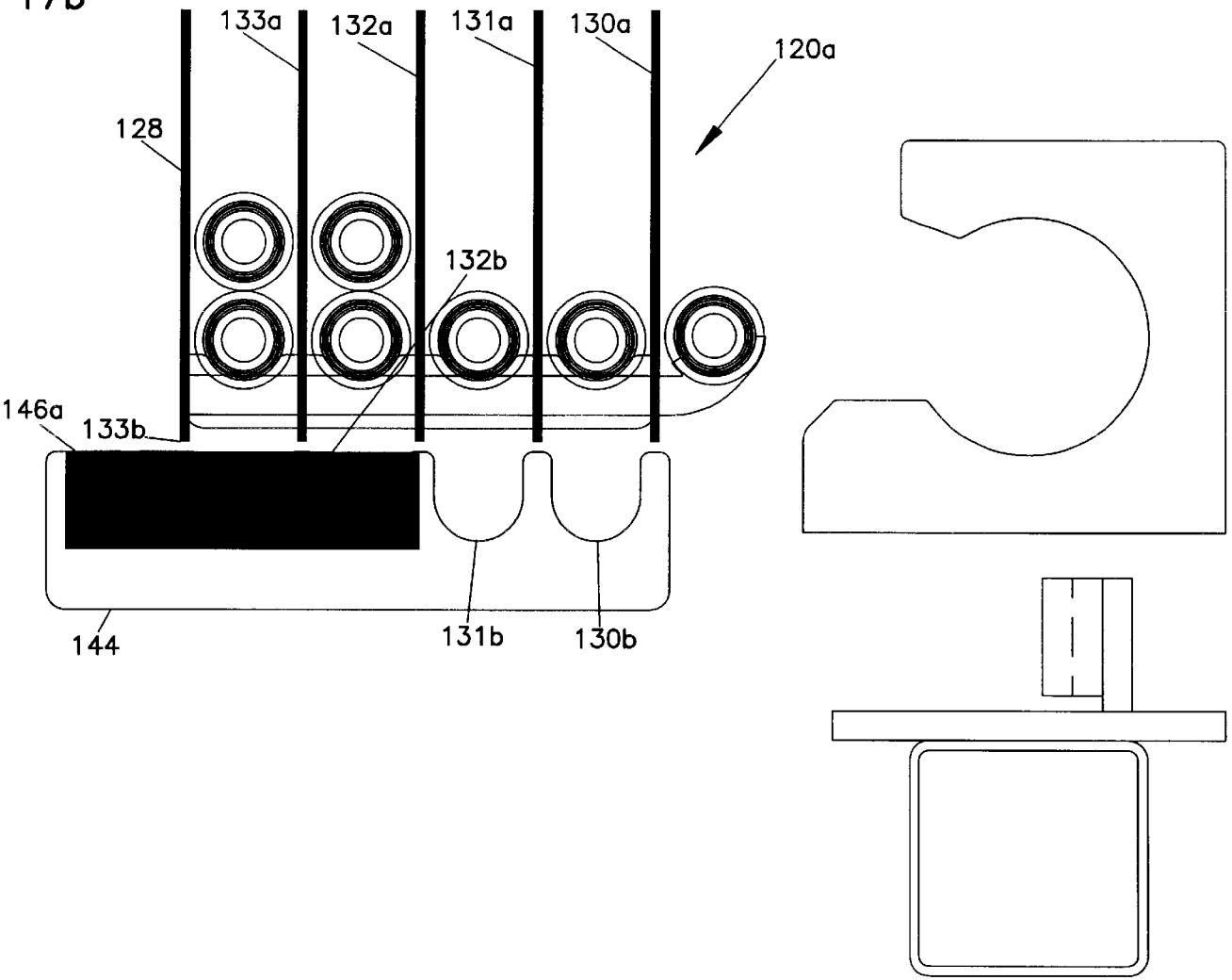
Figure 17C:
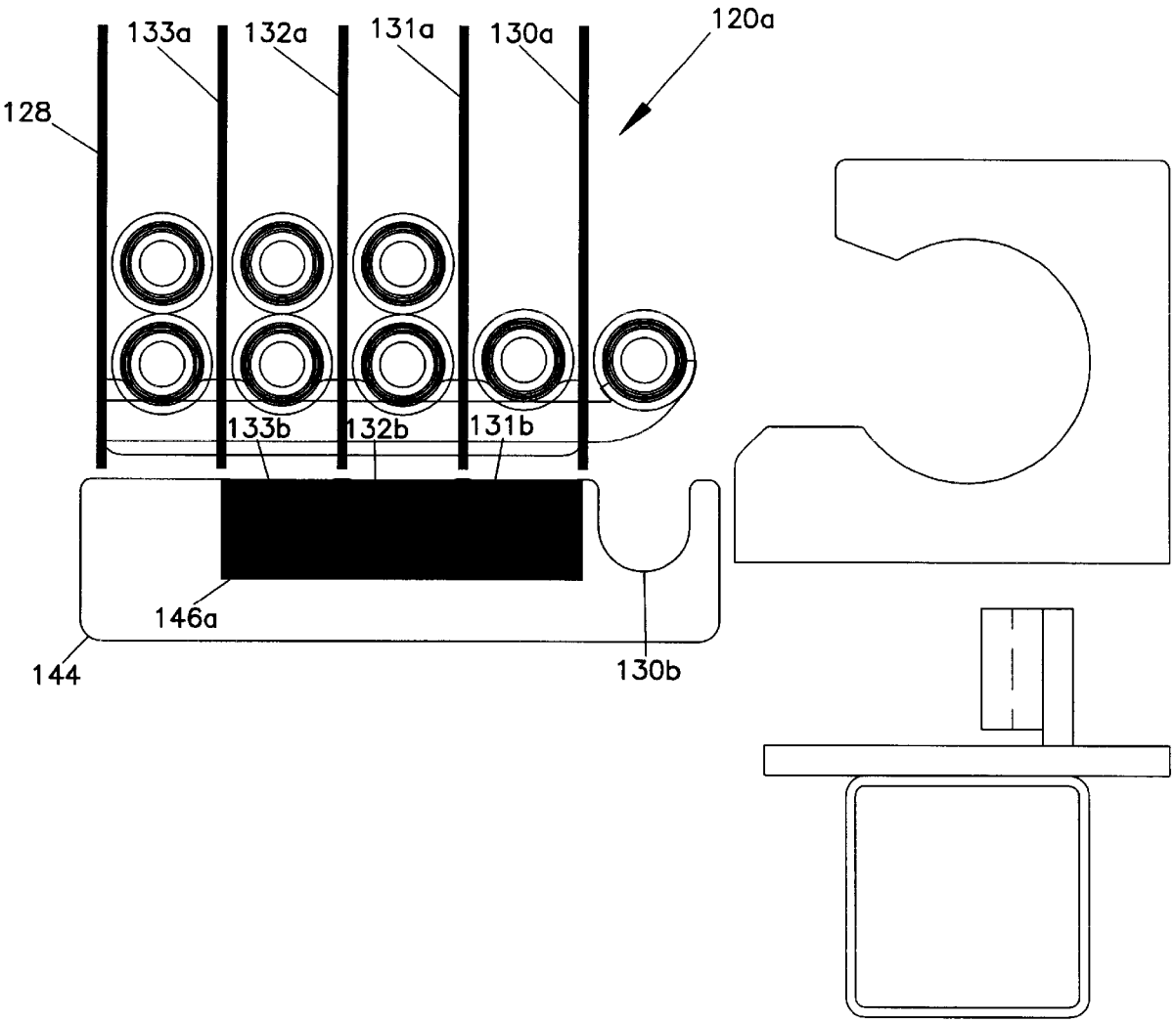

In certain embodiments, the directional drilling machine 120*a* can include an elongated blocker 146*a* (see FIGS. 17*a*–17*c*) mounted within or along-side the feed member 144 for blocking one or more of the pockets 131*b*–133*b*, preferably as rods are loaded back into the rod box 128 during a pull-back cycle. For example, as each column is filled with rods, the pocket corresponding to the filled column is preferably blocked. In FIGS. 17*a*–17*c*, it is assumed that a column is full when the column contains two rods. Thus, FIG. 17*a* shows pocket 133*b* blocked after column 133*a* has been filled, FIG. 17*b* shows pockets 132*b* and 133*b* blocked after columns 132*a* and 133*b* have been filled, and FIG. 17*c* shows pockets 131*b*–133*b* blocked after columns 131*a*–133*a* have been filled. When the blocker 146*a* is fully retracted, all of the pockets 130*b*–133*b* are open.

Figure 18A:
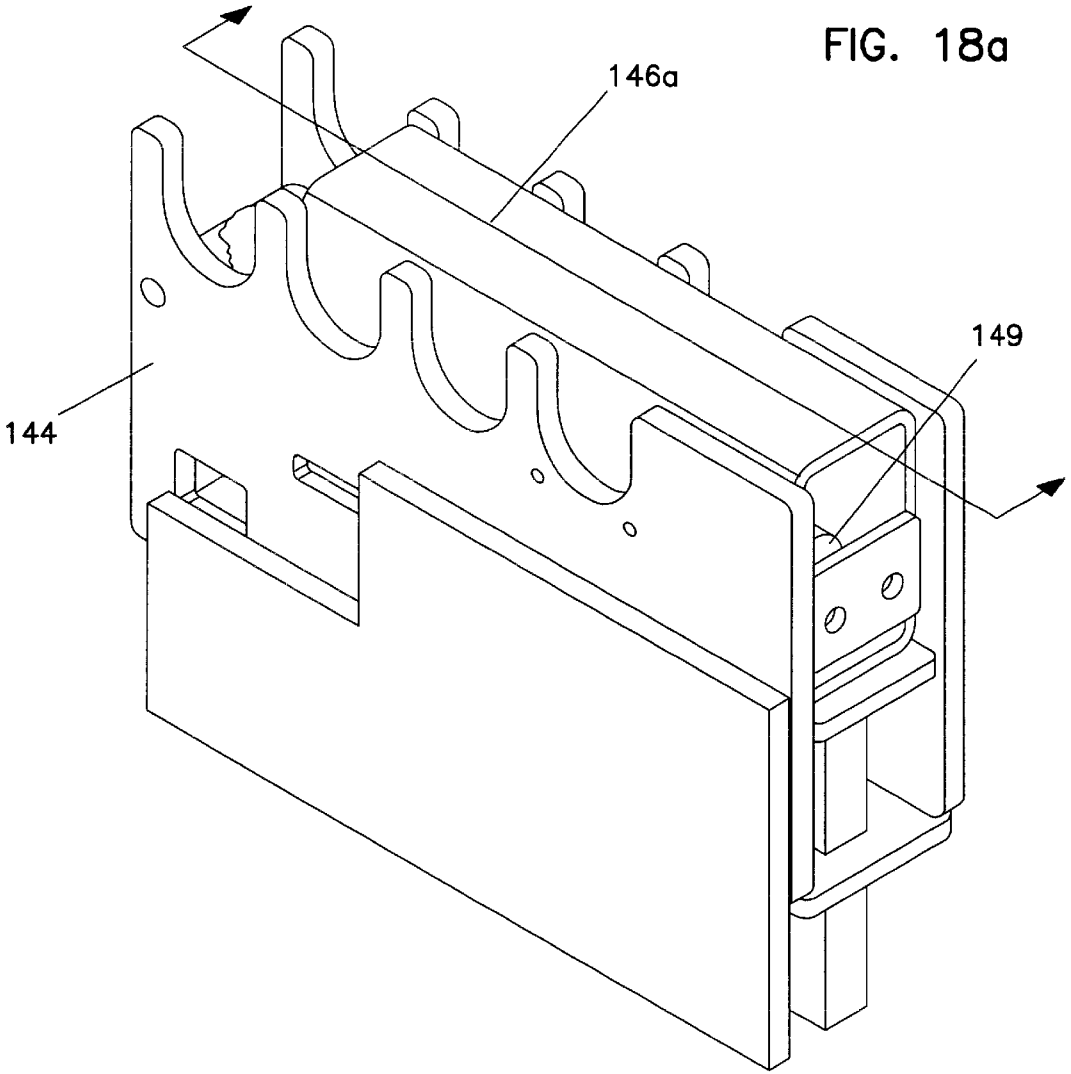
FIG. 18*a* illustrates a blocker suitable for use with the directional drilling machine of FIG. 15, the blocker is shown in a position in which three pockets of a corresponding feed member are blocked.
Figure 18B:
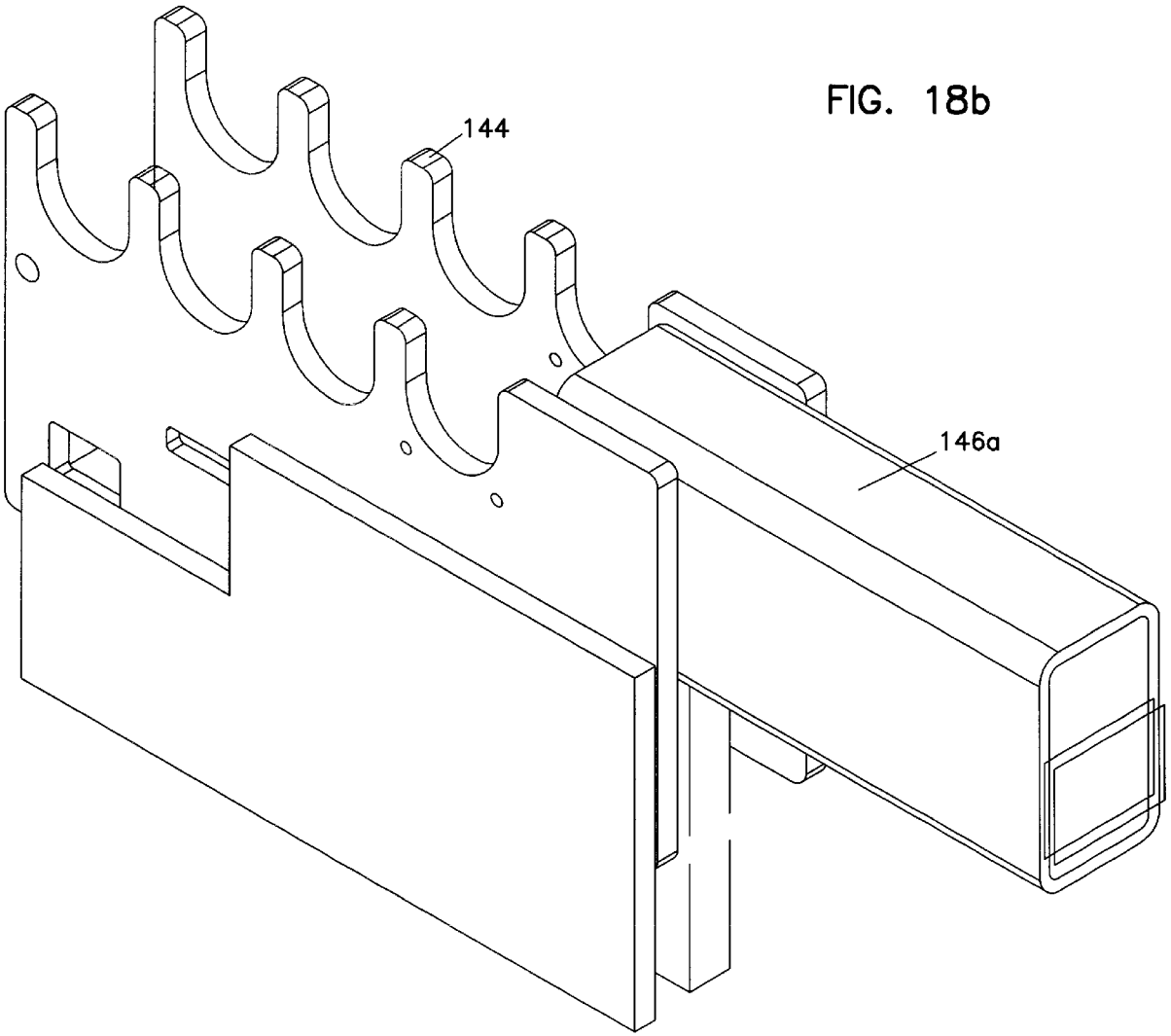
FIG. 18*b* illustrates the blocker of FIG. 18*a* in a non-blocking position.

FIGS. 18*a* and 18*b* show a representative configuration of the blocker 146*a*. The depicted blocker 146*a* is mounted to slide longitudinally within the feed member 144. FIG. 18*a* shows the blocker 146*a* positioned to block all but one of the pockets of the feed member 144, and FIG. 18*b* shows the blocker 146*a* in a non-blocking position.

Figure 19:
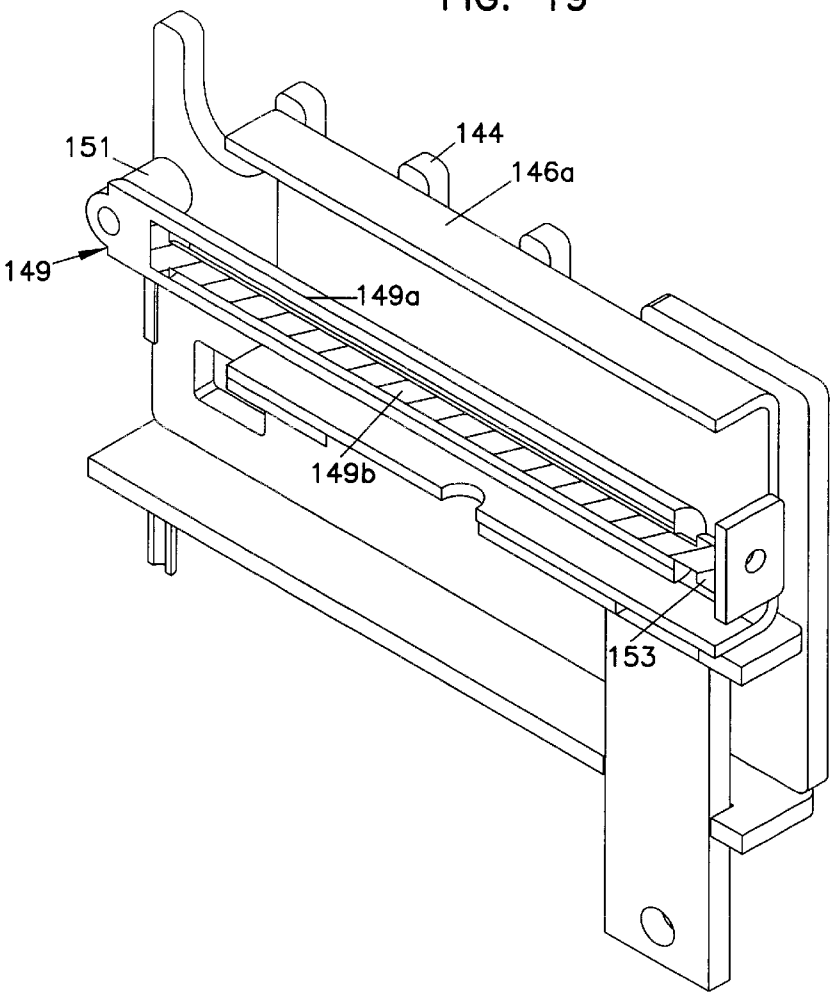
FIG. 19 is a cross-sectional view taken along section line 19—19 of FIG. 18*a*.

As shown in FIG. 19, a hydraulic cylinder 149 is provided for moving the blocker longitudinally relative to the feed member 144. The hydraulic cylinder 149 includes a cylinder 149*a* connected to the feed member 144 at connection location 151, and a piston rod 149*b* connected to the blocker 146*a* at connection location 153. It will be appreciated that actuation of the hydraulic cylinder can be controlled by a control system such as the system shown in FIGS. 14*a*–14*d*.

The above specification and examples provide a complete description of the manufacture and use of the composition of the invention. Since many embodiments of the invention can be made without departing from the spirit and scope of the invention, the invention resides in the claims hereinafter appended.

What is claimed is:

1. A horizontal directional drilling machine comprising:

a magazine for holding a plurality of elongated rods, the magazine including a plurality of columns in which the rods are held, each of the columns having a separate bottom opening;

a feed member that moves beneath the magazine, the feed member including a plurality of upwardly opening pockets for receiving the rods;

a lift unit for lifting rods from the pockets of the feed member up through the bottom openings of the columns, and for lowering rods from the bottom openings of the columns to the pockets of the feed member;

at least one blocking member moveable relative to the feed member so as to be positionable in:

i) a non-blocking position in which the at least one blocking member does not block any of the pockets; and ii) one or more blocking positions in which the at least one blocking member blocks one or more of the pockets such that rods are prevented from being lowered from the magazine into the blocked one or more pockets;

a sensor for sensing when a predetermined number of rods has been loaded into a first one of the columns; and a controller interfacing with the sensor for causing the at least one blocking member to move from the non-blocking position to the one or more blocking positions when the sensor senses that the predetermined number of rods has been loaded into the first column.

2. The horizontal directional drilling machine of claim 1, wherein the at least one blocking member includes a plurality of blocking members that can be separately actuated.

3. The horizontal directional drilling machine of claim 2, wherein the blocking members pivot up and down.

4. The horizontal directional drilling machine of claim 1, wherein the at least one blocking member includes a blocking member capable of simultaneously blocking all but one of the pockets.

5. The horizontal directional drilling machine of claim 1, wherein the at least one blocking member comprises an elongated blocker that is longitudinally moveable relative to the feed member.

6. The horizontal directional drilling machine of claim 5, further comprising a hydraulic cylinder for moving the elongated blocker relative to the feed member.

7. The directional drilling machine of claim 1, wherein the sensor detects when the first column is full.

8. The directional drilling machine of claim 1, wherein the magazine includes at least four columns, and wherein sensors are provided adjacent at least three of the columns.

9. The directional drilling machine of claim 8, wherein the feed member includes at least four pockets, and wherein the at least one blocking member is capable of blocking at least three of the pockets.

* * * * *